US008543364B2

(12) United States Patent
Liu et al.

(10) Patent No.: US 8,543,364 B2
(45) Date of Patent: Sep. 24, 2013

(54) METHOD FOR OPTIMIZING WELL PRODUCTION IN RESERVOIRS HAVING FLOW BARRIERS

(75) Inventors: Song Liu, Beijing (CN); Lixin Tian, Tianjin (CN); Xian-Huan Wen, Pleasanton, CA (US); Chunming Zhao, Tiajin (CN); Qinghong Yang, Tiajin (CN); Peng Zhang, Tiajin (CN); Dengen Zhou, Sugar Land, TX (US); Bo Li, Beijing (CN); Lichuan Lan, Tiajin (CN); Lizhen Ge, Tiajin (CN); Xinwu Liao, Tiajin (CN); Fengli Zhang, Tiajin (CN); Michael Sheng-Wei Wei, Sugar Land, TX (US)

(73) Assignees: Chevron U.S.A. Inc., Sam Ramon, CA (US); China National Offshore Oil Corporation, Chaoyangmenbei Dajie, Dongcheng District, Beijing (CN)

( * ) Notice: Subject to any disclaimer, the term of this patent is extended or adjusted under 35 U.S.C. 154(b) by 794 days.

(21) Appl. No.: 12/561,830

(22) Filed: Sep. 17, 2009

(65) Prior Publication Data

US 2010/0071897 A1 Mar. 25, 2010

Related U.S. Application Data

(60) Provisional application No. 61/098,609, filed on Sep. 19, 2008.

(51) Int. Cl.
*G06G 7/48* (2006.01)

(52) U.S. Cl.
USPC ..... 703/10

(58) Field of Classification Search
USPC ..... 703/10; 166/245; 702/12
See application file for complete search history.

(56) References Cited

U.S. PATENT DOCUMENTS

| | | | | |
|---|---|---|---|---|
| 4,026,360 | A | 5/1977 | Drinkard | |
| 4,475,593 | A | 10/1984 | Friedman | |
| 4,662,449 | A * | 5/1987 | Friedman | 166/295 |
| 4,817,720 | A | 4/1989 | Friedman et al. | |
| 5,835,882 | A | 11/1998 | Vienot et al. | |
| 2007/0295499 | A1 * | 12/2007 | Arthur et al. | 166/245 |

OTHER PUBLICATIONS

Karp., J.C., Lowe, D.K. and Marusov, N.: "Horizontal barriers for controlling water coning", Trans. AIME vol. 225, 783-790, 1962.
Stickland, R.F.: "Artificial barriers may control water coning". Oil & Gas Journal, 61-64, Oct. 7, 1974.

(Continued)

*Primary Examiner* — Omar Fernandez Rivas
*Assistant Examiner* — Bernard E Cothran
(74) *Attorney, Agent, or Firm* — Craig R. Vander Ploeg; Christopher D. Northcutt

(57) ABSTRACT

Computer-implemented systems and methods are provided for optimizing hydrocarbon recovery from subsurface formations, including subsurface formations having bottom water or edgewater. A system and method can be configured to receive data indicative of by-pass oil areas in the subsurface formation from reservoir simulation, identify flow barriers in the subsurface formation based on the by-pass oil areas identified by the reservoir simulation, and predict the lateral extension of the identified flow barriers in the subsurface formation. Infill horizontal wells can be placed at areas of the subsurface formation relative to the flow barriers such that production from a horizontal well in the subsurface formation optimizes hydrocarbon recovery.

27 Claims, 33 Drawing Sheets

(56) References Cited

OTHER PUBLICATIONS

Richardson, J.G., Harris, D.G., Rossen, R.H. and Van Hee, G.: "The effect of small, discontinuous shales on oil recovery", JPT (Nov. 1978), 1531-1537.

Lien, SC, Haldorsen, H.H., and Manner. M.: "Horizontal wells: Still appealing in formations with discontinuous vertical permeability barriers?", JPT (Dec. 1992), 1364-1370.

Permadi, P., Lee, R,L., and Kartoatmodjo, R.S.T.: "Behavior of water cresting under horizontal wells", paper SPE 30743 presented at the 1995 SPE Annual Technical Conference & Exhibition, Dallas, Oct. 22-25.

Permadi, P., Gustiawan E., and Abdassah D.: "Water cresting and oil recovery by horizontal wells, in the presence of impermeable streaks", SPE paper 35440 presented at the 1995 SPE/DOE tenth Symposium on Improved Oil Recovery held in Tules, OK, USA, Apr. 21-24.

Ekrann, S.: "On the protection against coning by horizontal barriers of limited lateral extent", paper presented at the 6$^{th}$ European IOR-Symposium, Stavanger, May 21-23, 1991.

Islam, M.R. and Farouq Ali. S.M.: "Improving waterflood performance in oil reservoirs with bottomwater", paper SPE 16727 presented at the 1987 SPE Annual Technical Conference & Exhibition, Dallas, Sep. 27-30.

Siddiqi, S.S. and Wojtanowicz, A.K.: "A study of water coning control in oil wells by injected or natural flow barriers using scaled physical and numerical simulator", paper SPE 77415 presented at the 2002 SPE Annual Technical Conference & Exhibition, San Antonio, TX, Sep. 29-Oct. 2.

De Ghetto, G. and Kassack, Ch.: "Control of water and gas coning by dynamic pressure barrier: application to a carbonate reservoir", paper presented at the 8$^{th}$ European IOR-Symposium, Vienna. May 15-17, 1995.

Chen, H.K.: "Performance of horizontal wells, Safah Field, Oman", paper SPE 25568 presented at the 1993 SPE Middle East Oil Technical Conference & Exhibition, Bahrain, Apr. 3-6.

Dikken, B.J.: "Pressure drop in horizontal wells and its effect on production performance", JPT (Nov. 1990), 1426-1433.

Ehlig-Economides, C.A., Chen, K-S, and Spath, J.B.: "Production enhancement strategies for strong bottom water drive reservoirs", paper SPE 36613 presented at the 1996 SPE Annual Technical Conference & Exhibition, Denver, CO USA Oct. 5-7.

Renard, G., Palmgren, Cl., Gadelle, C., Lesage, J., Zaitoun, A., Carlay, Ph., and Chauretean, G.: "Preliminary study of a new dynamic technique to prevent water coning", paper presented at the 8$^{th}$ European IOR-Symposium, Vienna, May 15-17, 1995.

PCT International Search Report and Written Opinion dated May 10, 2010 (6 pages).

* cited by examiner

Proportion of Flow Barriers: 20%

Proportion of Flow Barriers: 10%

Proportion of Flow Barriers: 5%

Impact of permeability of flow barriers

Correlation length of flow barriers: 200 m
Proportion of flow barriers: 10%

K_barrier= 1 md

Fig. 2C

Impact of permeability of flow barriers

Correlation length of flow barriers: 200 m
Proportion of flow barriers: 10%

K_barrier= 20 md

Fig. 2D

Using reservoir simulation to identify "by-pass" oil areas

↓

Identifying flow barriers, such as from existing well logs, and predicting/correlating the lateral extension of flow barriers between wells

↓

Placing infill horizontal wells at areas with high remaining oil saturation and flow barriers between the well paths and water/oil contact

↓

The existence of flow barriers may be verified using pilot hole drilling

↓

Placing horizontal well near the top of the oil column and drilling the horizontal section as long as permitted by well spacing

↓

Producing the horizontal well with small drawdown to control the water coning and then increasing liquid production rate when water cut is high

Fig. 17

METHOD FOR OPTIMIZING WELL PRODUCTION IN RESERVOIRS HAVING FLOW BARRIERS

1. CROSS-REFERENCE TO RELATED APPLICATIONS

This application claims priority to U.S. Provisional Application No. 61/098,609, filed Sep. 19, 2008, which is incorporated herein by reference in its entirety.

2. TECHNICAL FIELD

This document relates to systems and methods for optimizing hydrocarbon recovery from subsurface formations, including subsurface formations having bottom water or edgewater. This document also relates to systems and methods for optimizing hydrocarbon recovery in subsurface formations having flow barriers.

3. BACKGROUND

Conventional vertical wells can create severe coning problems in water drive reservoirs, such as in thin bottom water reservoirs or edgewater reservoirs. Bottom water reservoirs are situated above an aquifer, and there can be a continuous substantially horizontal interface between the reservoir fluid and the aquifer water (water/oil contact). In an edgewater reservoir, only a portion of the reservoir fluid can be substantially in contact with the aquifer water (water/oil contact). Reservoir fluid, comprising hydrocarbons such as but not limited to oil, can be produced from these water drive reservoirs by an expansion of the underlying water and rock, which can force the reservoir fluid into a wellbore. Coning problems can arise because the actual rate of production can exceed the critical rate where the flat surface of water/oil contact begins to deform. Historically, wells producing at critical water-free rates can be less profitable. Horizontal wells have been used to enhance oil production from water drive reservoirs and are typically considered a better alternative than conventional vertical wells as they provide for better economics, improved oil recovery and higher development efficiency. Long horizontal wellbores are able to contact a large reservoir area such that for a given rate, horizontal wells require a lower drawdown, resulting in a less degree of coning/cresting.

Horizontal wells have been employed for enhancing oil recovery from reservoirs having thin oil zones, generally ranging between five and twenty meters, with strong bottom water, such as those found in Bohai Bay of eastern China. To maximize oil production and avoid early water coning or cresting, horizontal wells can be placed near the top of oil sand bodies and wells can be produced with small pressure drawdown before water breakthrough. Nevertheless, the production responses from different horizontal wells can be significantly different from each other even though they are operated under similar conditions. For example, some wells can show premature water coning within a very short time and rapid water cut rising, while others can show later water breakthrough and steady increase of water cut for a longer time.

The existence of thin discontinuous low permeable or impermeable flow barriers with limited horizontal extension or continuity between the wellbore and water/oil contact can impact water coning characteristics. For example, the presence of a flow barrier can be beneficial, as the cumulative water production to produce the same amount of oil can be less and the time required to produce the same amount of oil can be shorter than without the barriers. Additionally, once water reaches the barrier, coning can be limited because the pressure drawdown caused by production can be less at the edge of the barriers than at the well in the absence of the barriers. In some instances, the effects of a completely impermeable barrier on the cone shape can be equivalent to extending the wellbore out to the radius of the barrier.

The productivity of vertical and horizontal wells in formations containing discontinuous shales has been investigated using numerical simulation. For single phase oil flow, the discontinuous shale shows a decrease in the productivity index (or PI) ratio between horizontal and vertical wells. For two-phase oil/water flow in a bottom water reservoir, the randomly distributed discontinuous shales show an increased oil recovery by decreasing water cut in both horizontal and vertical wells (compared with wells without shales). In other words, shales typically shield the horizontal wells from the rising water cone, resulting in lower water cut values. In general, although the total well productivity typically decreases when shales are present, the productivity of oil increases due to the sheltering effect of the shale on water advancement. Accordingly, the long-term effects of discontinuous shales appear to be beneficial with respect to oil production.

The water/oil contact movement in a reservoir containing impermeable layers, where oil can be produced through a horizontal well, has also been investigated using transparent physical 2-D models. Results have shown that increased oil recovery can be obtained when the heel end of a long horizontal well is located above the upper layer of the impermeable streaks. Discontinuous impermeable layers or streaks in a bottom water reservoir act as obstacles to vertical reservoir flow or reduced vertical equivalent permeability. This condition can lead to delayed water breakthrough and significantly improved oil production. Oil production in heterogeneous cases has also shown to be better than in the homogeneous cases, such that they have delayed water breakthrough and slower water cut increases.

Field data has shown that flow barriers benefit horizontal well performance. For example, horizontal wells have been known to produce oil almost one year before the water breakthrough. In light of this, others have suggested to place man-made impermeable barriers around the wellbore to stop the water cone/crest from forming. Others have also suggested using chemicals, such as a polymer, to partially plug bottom water zones in order to improve well production performance in bottom water reservoirs. Others have also recommended drilling long horizontal wells as far from the water/oil contact as possible to improve well performance. However, without the knowledge of physical locations and size of flow barriers, long-term production testing may be needed to obtain reliable pre-development data on the influence of these flow barriers.

4. SUMMARY

As disclosed herein, systems and methods are provided for optimizing hydrocarbon recovery from subsurface formations, including subsurface formations having bottom water or edgewater. Systems and methods also are provided for optimizing hydrocarbon recovery in subsurface formations having flow barriers.

For example, a system and method for identifying potential infill areas and optimizing well locations are provided, the method comprising: identifying by-pass oil areas of the subsurface formation using one or more reservoir simulations; identifying one or more flow barriers in the subsurface formation from well logs based on the by-pass oil areas identified by the one or more reservoir simulations; predicting the lateral extension of the identified flow barriers in the subsurface formation; placing one or more horizontal infill wells at areas of the subsurface formation that have high remaining oil saturation and such that the one or more flow barriers are positioned between the paths of the one or more horizontal infill wells and an area of contact between water and oil in the subsurface formation; and placing at least one horizontal well near the top of an oil column of the subsurface formation. The horizontal section can be drilled for as long as permitted by the well spacing. Producing the horizontal well with small drawdown can control the water coning. The liquid production rate can be increased when the water cut is high (e.g., 80-90%).

A system and method can be configured to: receive data indicative of physical properties associated with materials in the subsurface formation and perform one or more computations and/or reservoir simulations for identifying "by-pass" oil areas.

A system and method can be used to identify and demonstrate the impact of flow barriers on horizontal well performance. The sensitivity of different parameters of flow barriers on horizontal well performance can be identified.

A system and method provide for utilization of the sensitivity of different parameters of flow barriers on horizontal well performance in infill drilling optimization to improve oil production of infill wells. A workflow can be provided for infill drilling that utilizes the sensitivity of different parameters of flow barriers on horizontal well performance in infill drilling optimization to improve oil production of infill wells.

5. BRIEF DESCRIPTION OF THE DRAWINGS

FIGS. 1A-C are schematic views of one realization of a reservoir model with different proportion of flow barriers;

FIGS. 1D-F are schematic views of the cumulative oil production for the realizations in FIGS. 1A-C;

FIGS. 2A-D are schematic views of one realization of a reservoir model with different proportion of flow barriers;

FIGS. 2E-H are schematic views of the cumulative oil production for the realizations in FIGS. 2A-D;

Figure 8B:
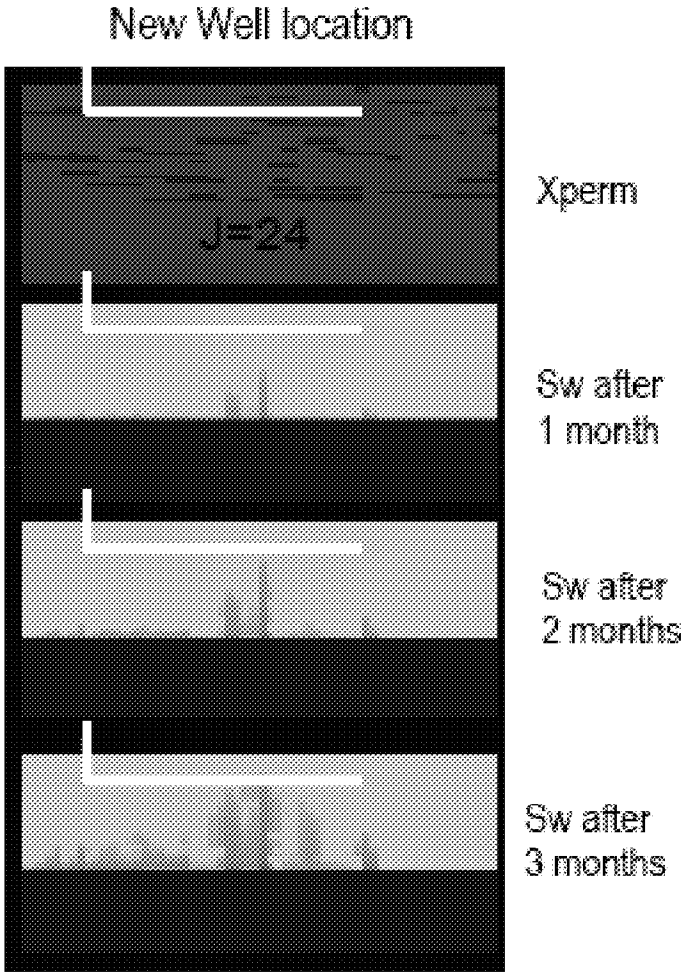
Figure 8A:
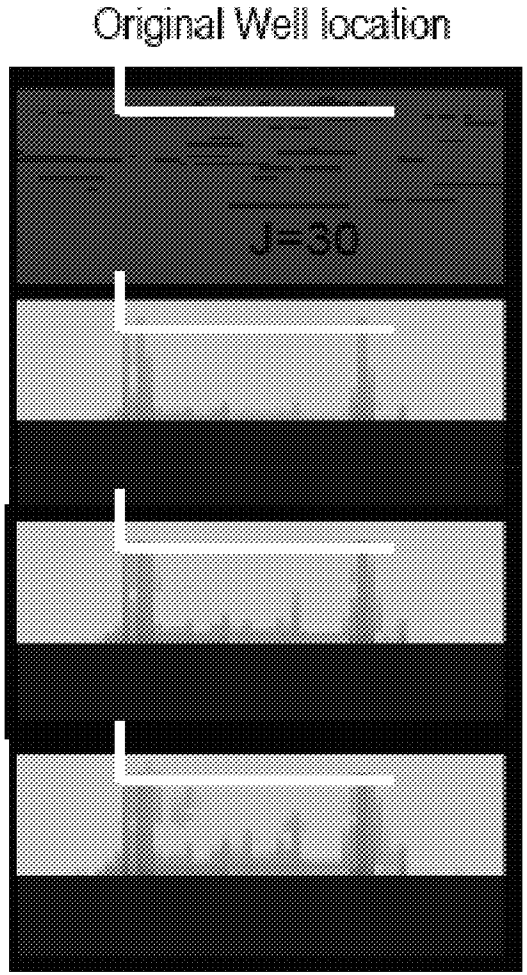
Figure 9:
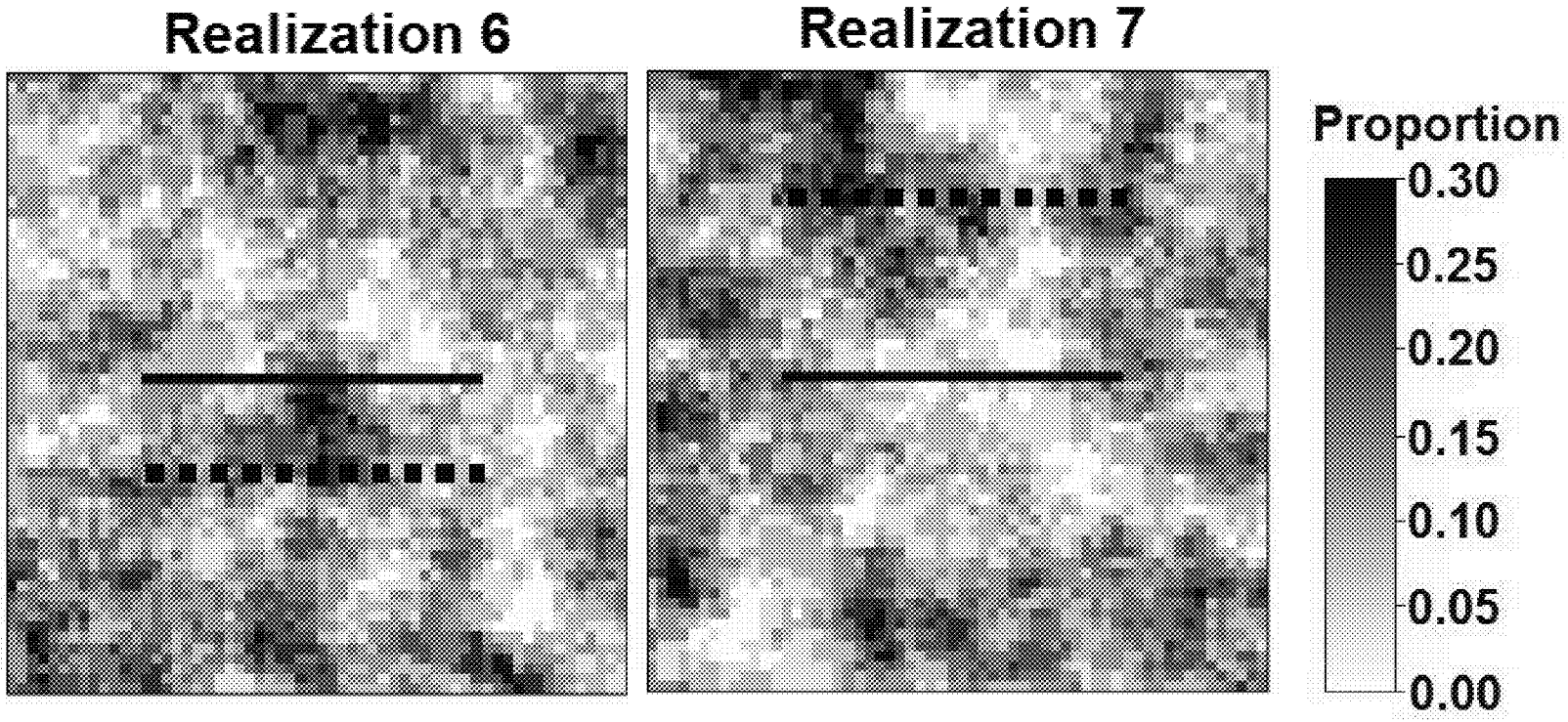
Figure 10A:
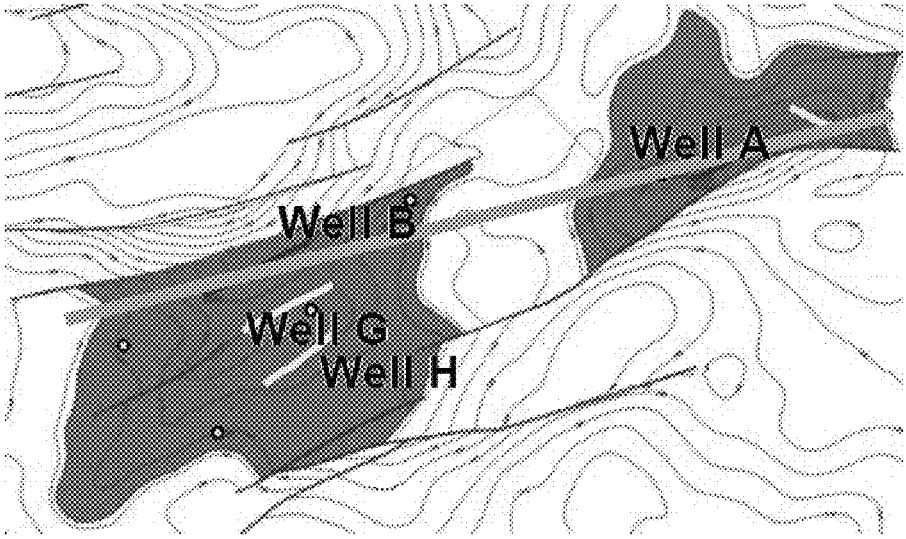
Figure 10B:
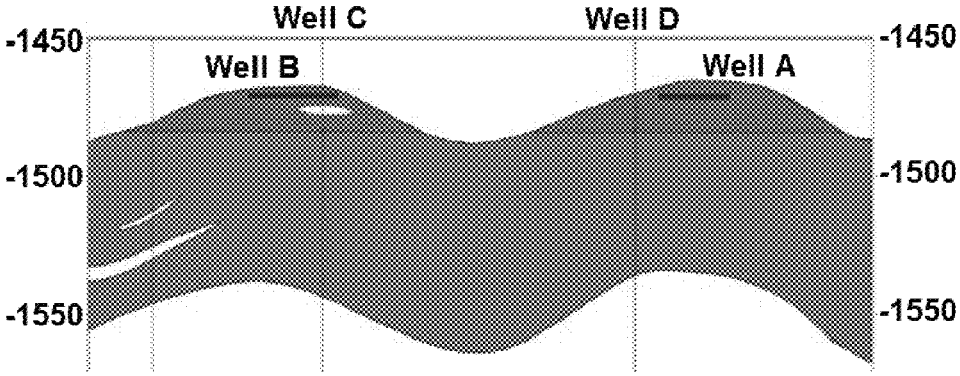
Figure 11A:
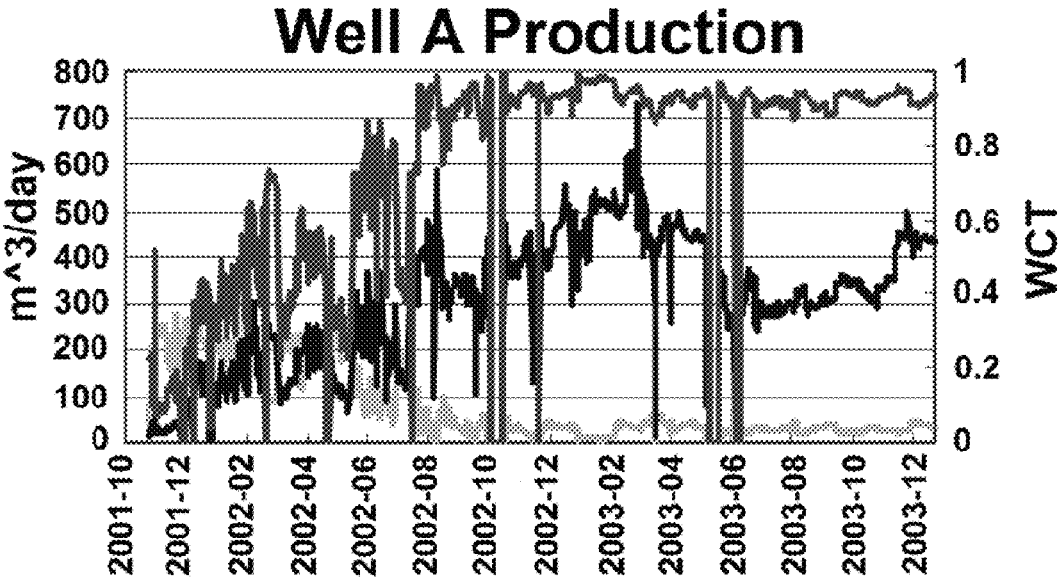
Figure 11B:
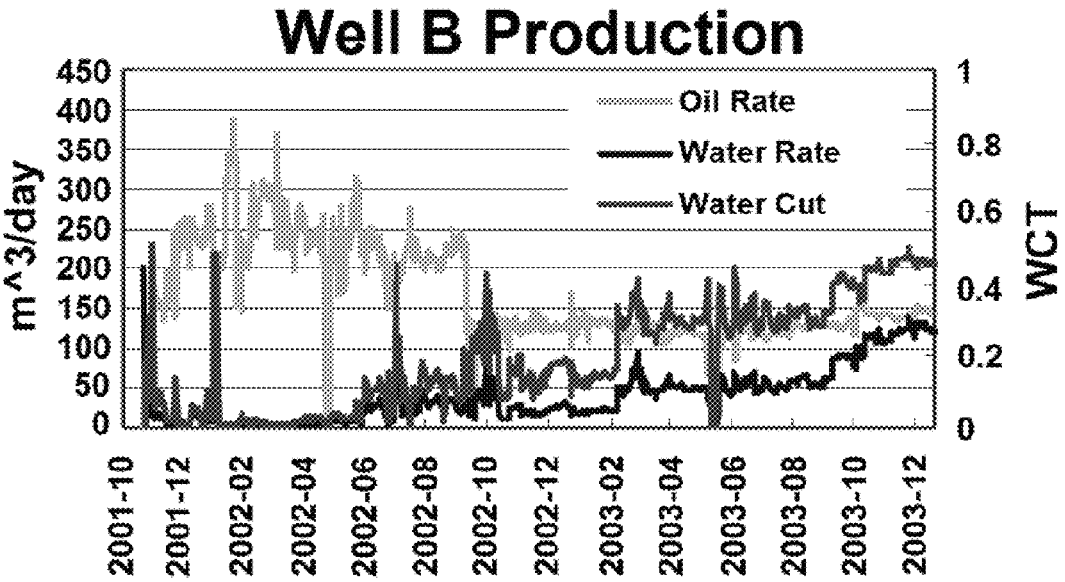
Figure 12:
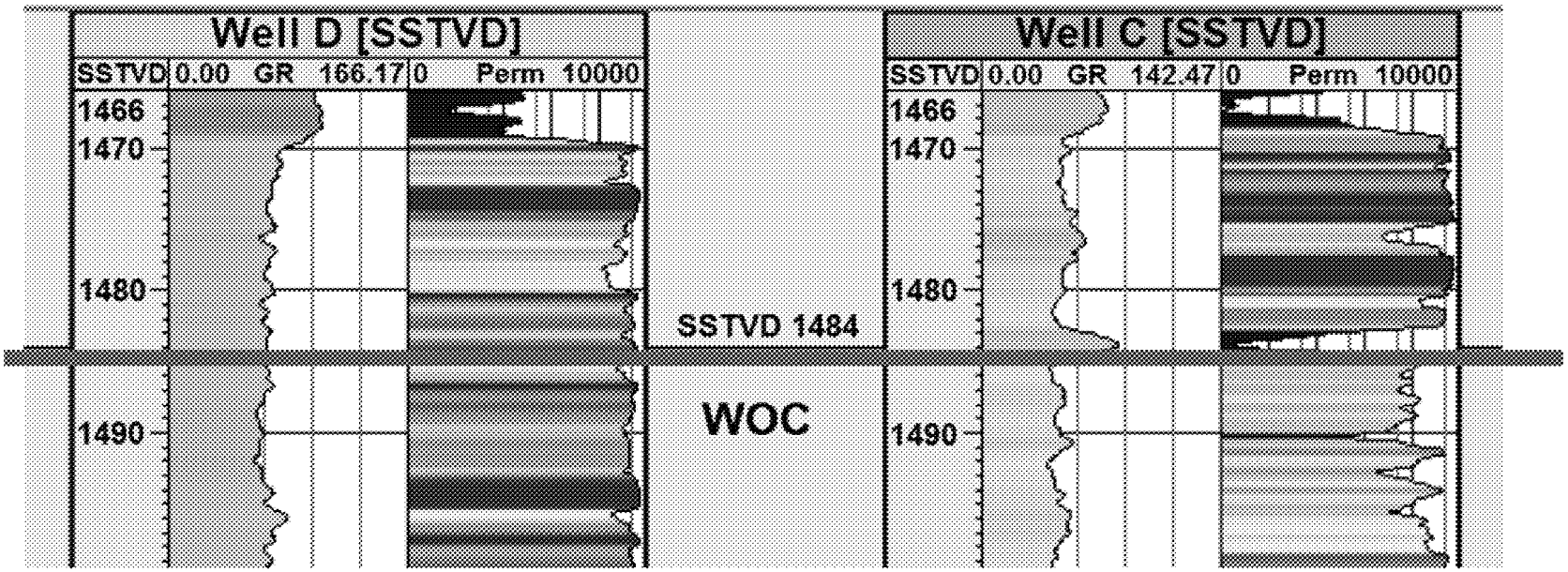
Figure 13A:
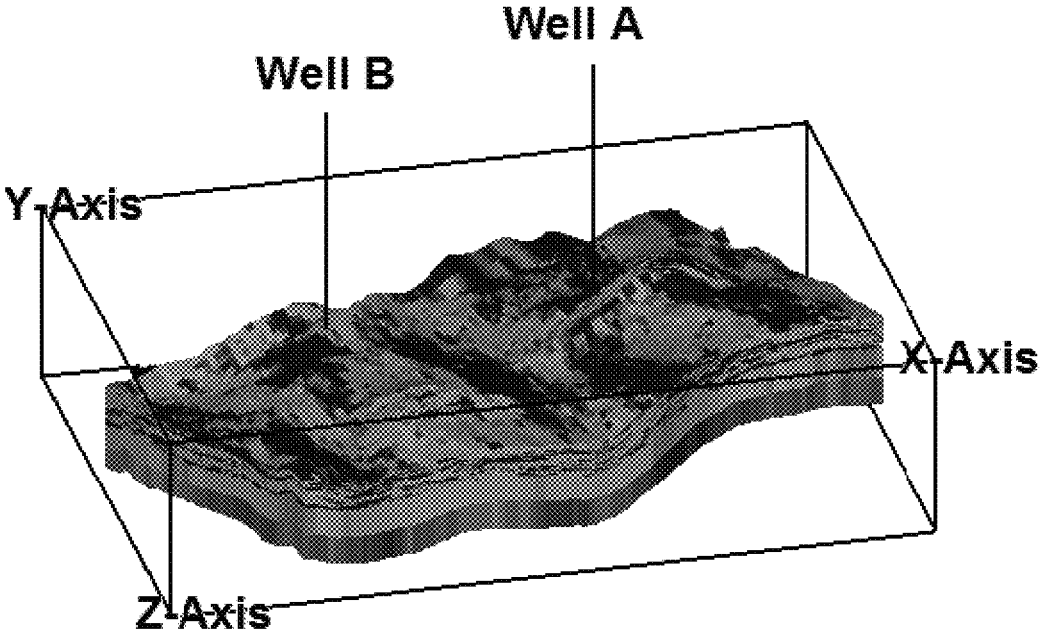
Figure 13B:
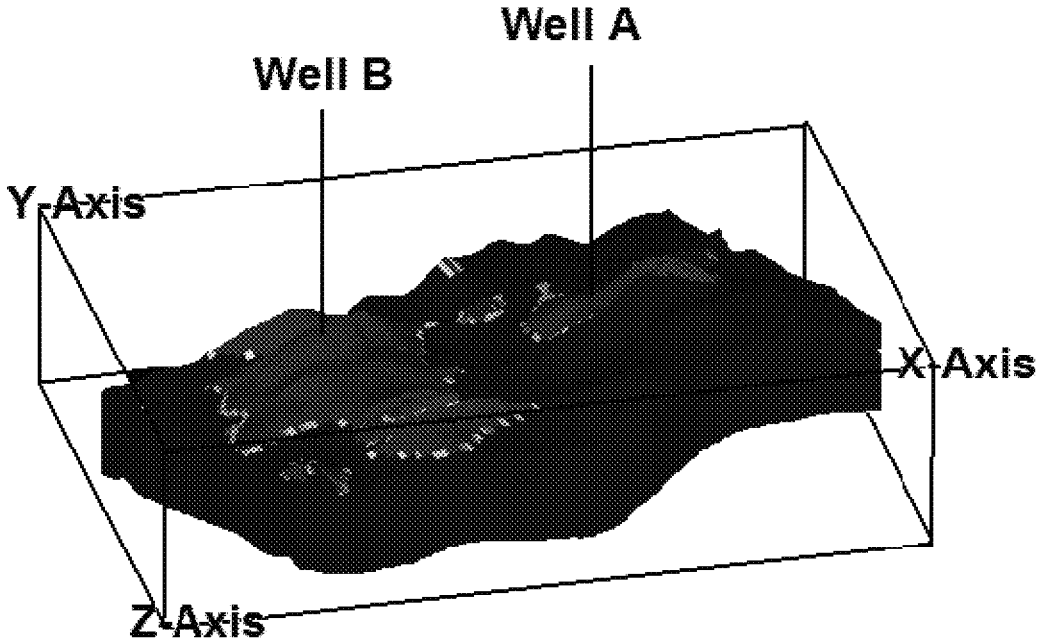
Figure 13C:
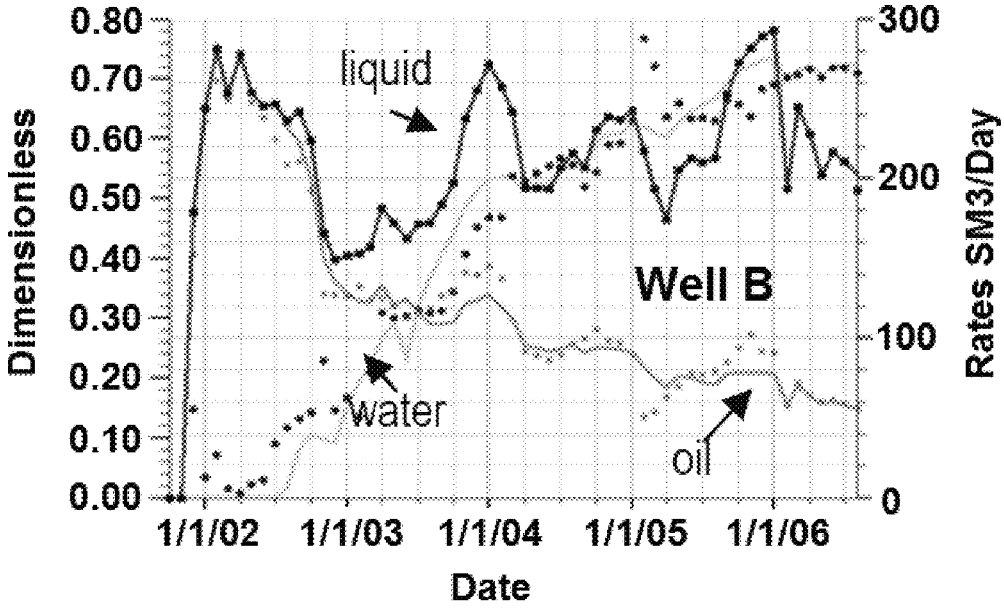
Figure 13D:
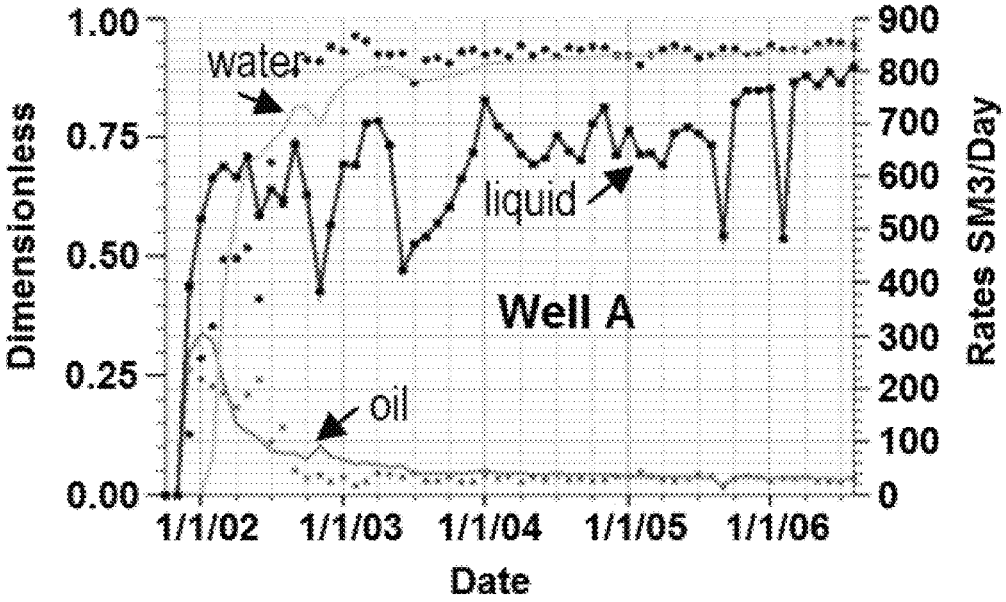
Figure 14A:
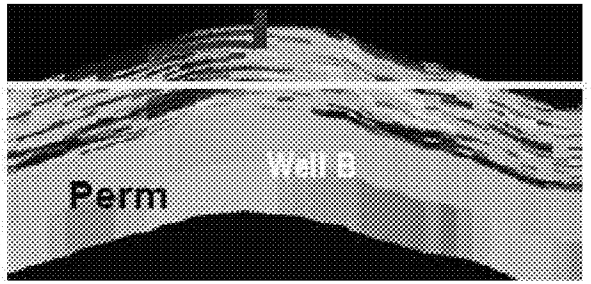
Figure 14B:
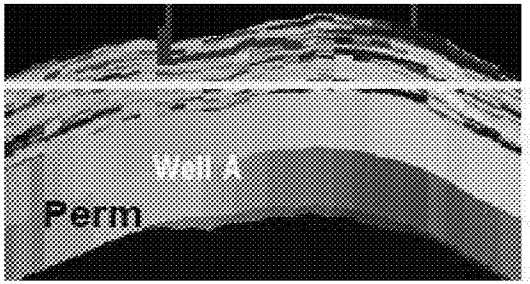
Figure 14C:
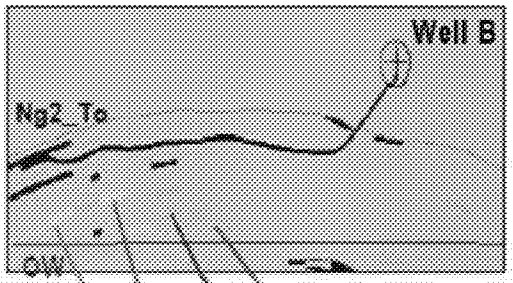
Figure 14D:
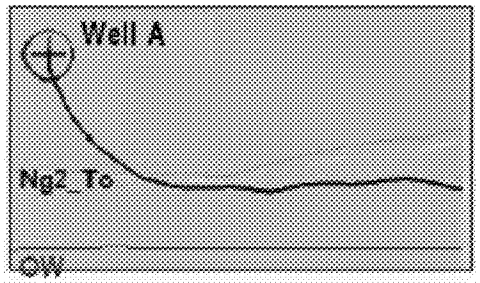
Figure 14E:
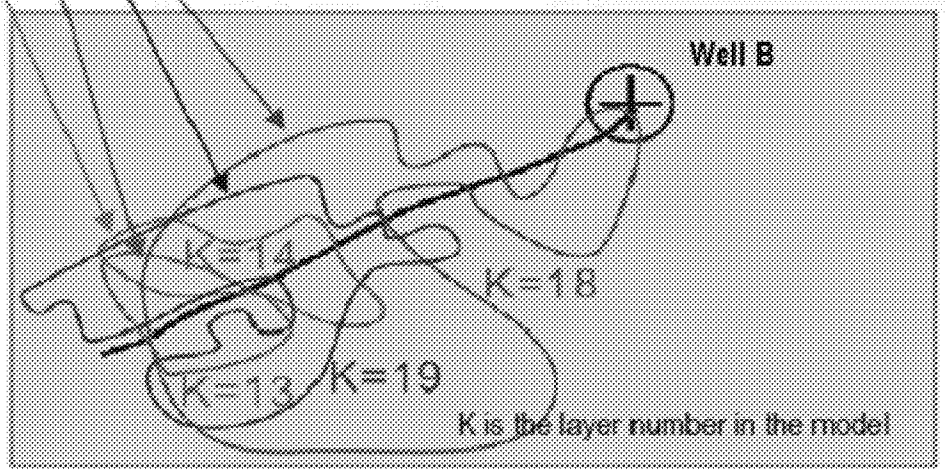
Figures 15A, 15B:
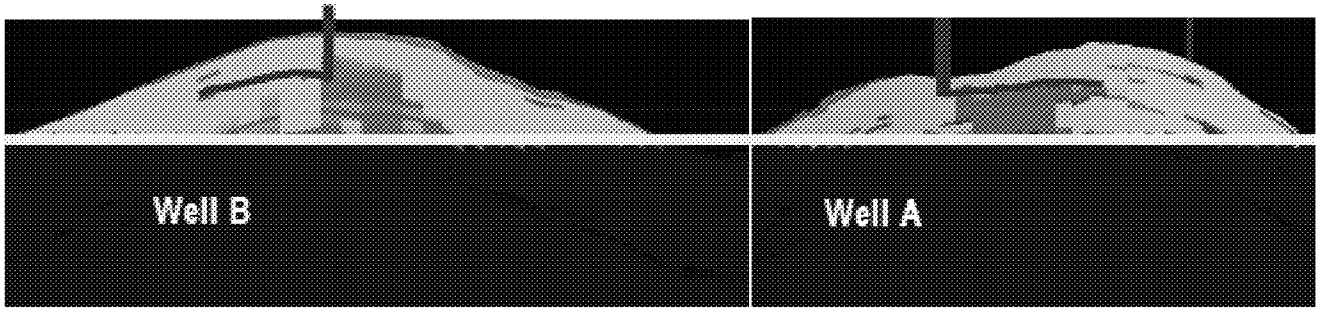
Figure 16:
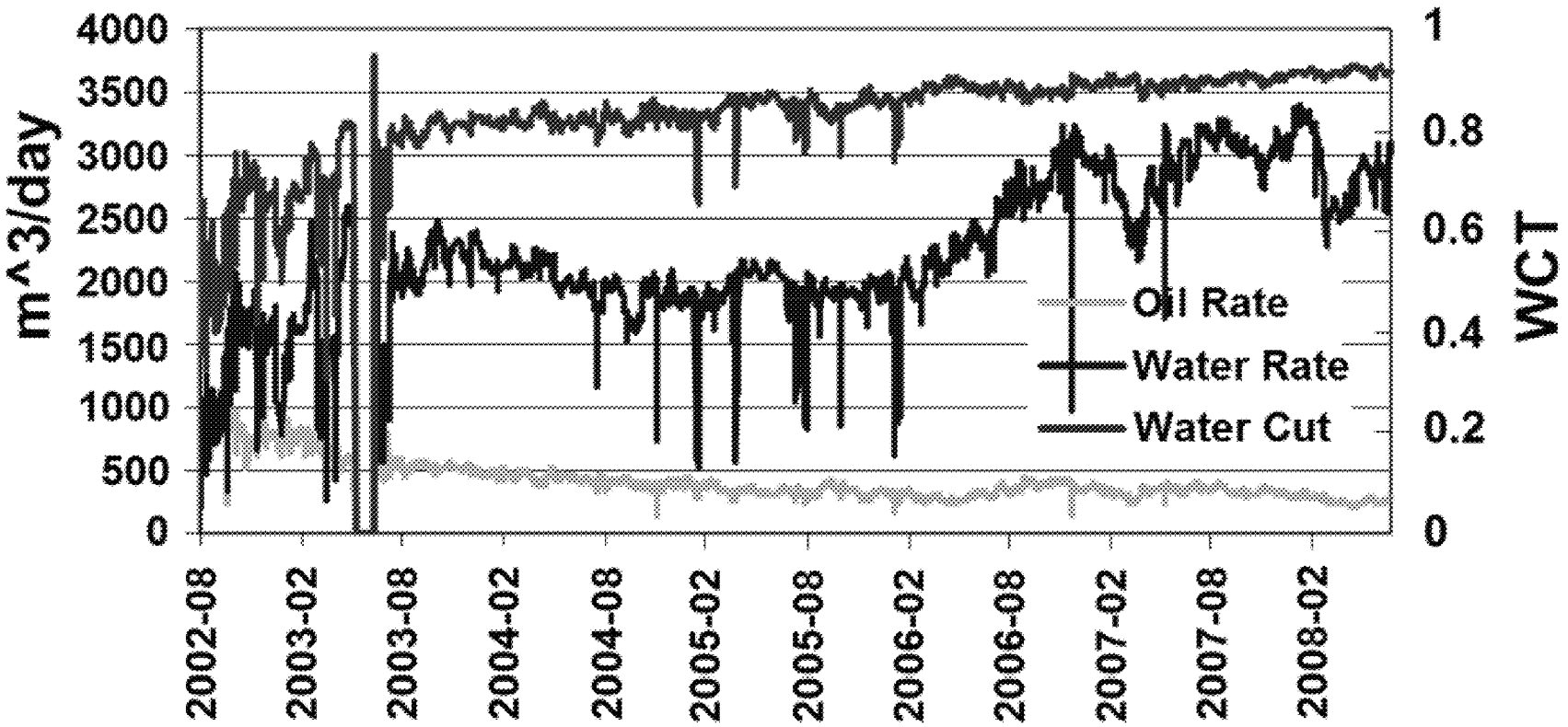
Figure 18:
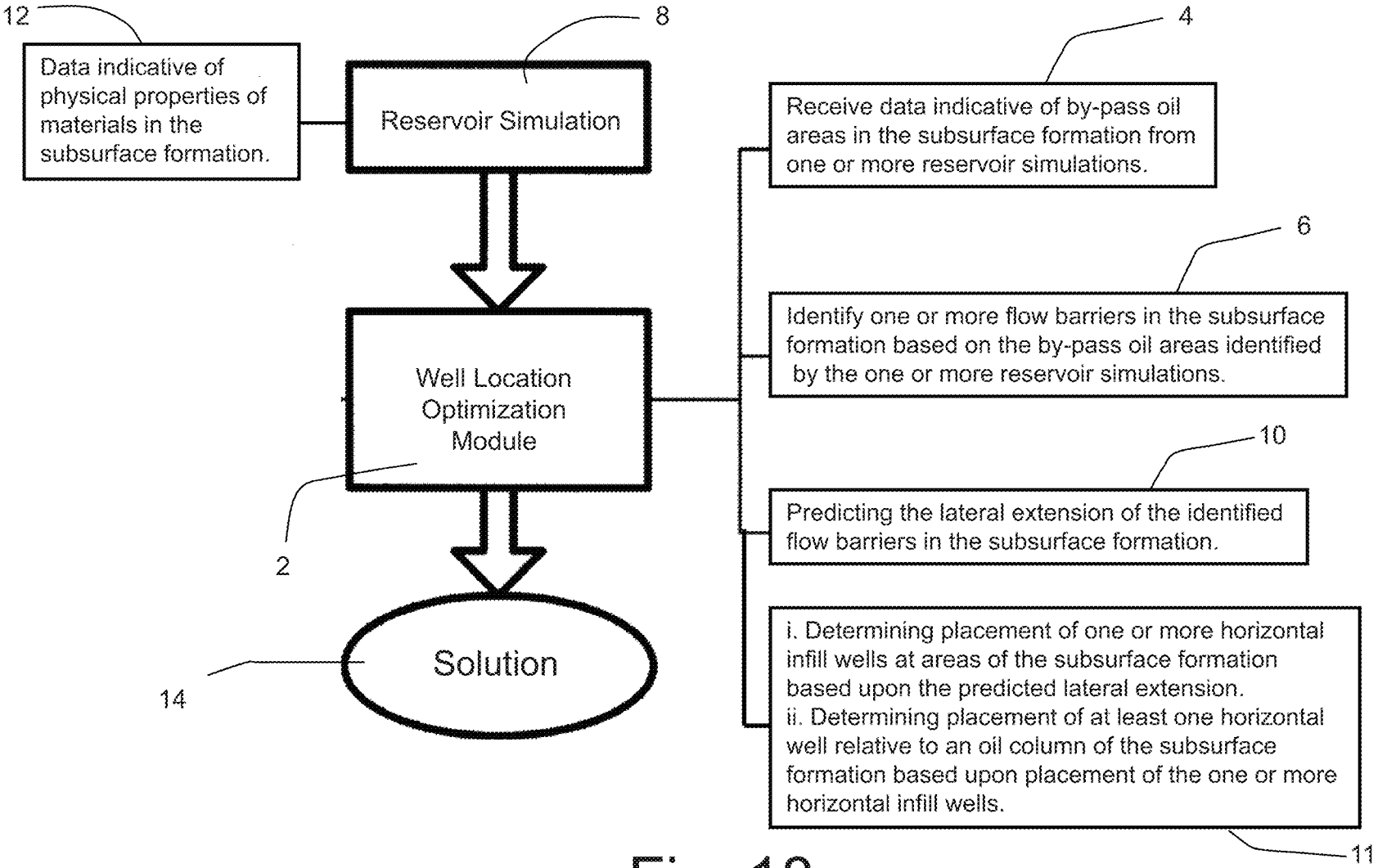
Figure 19:
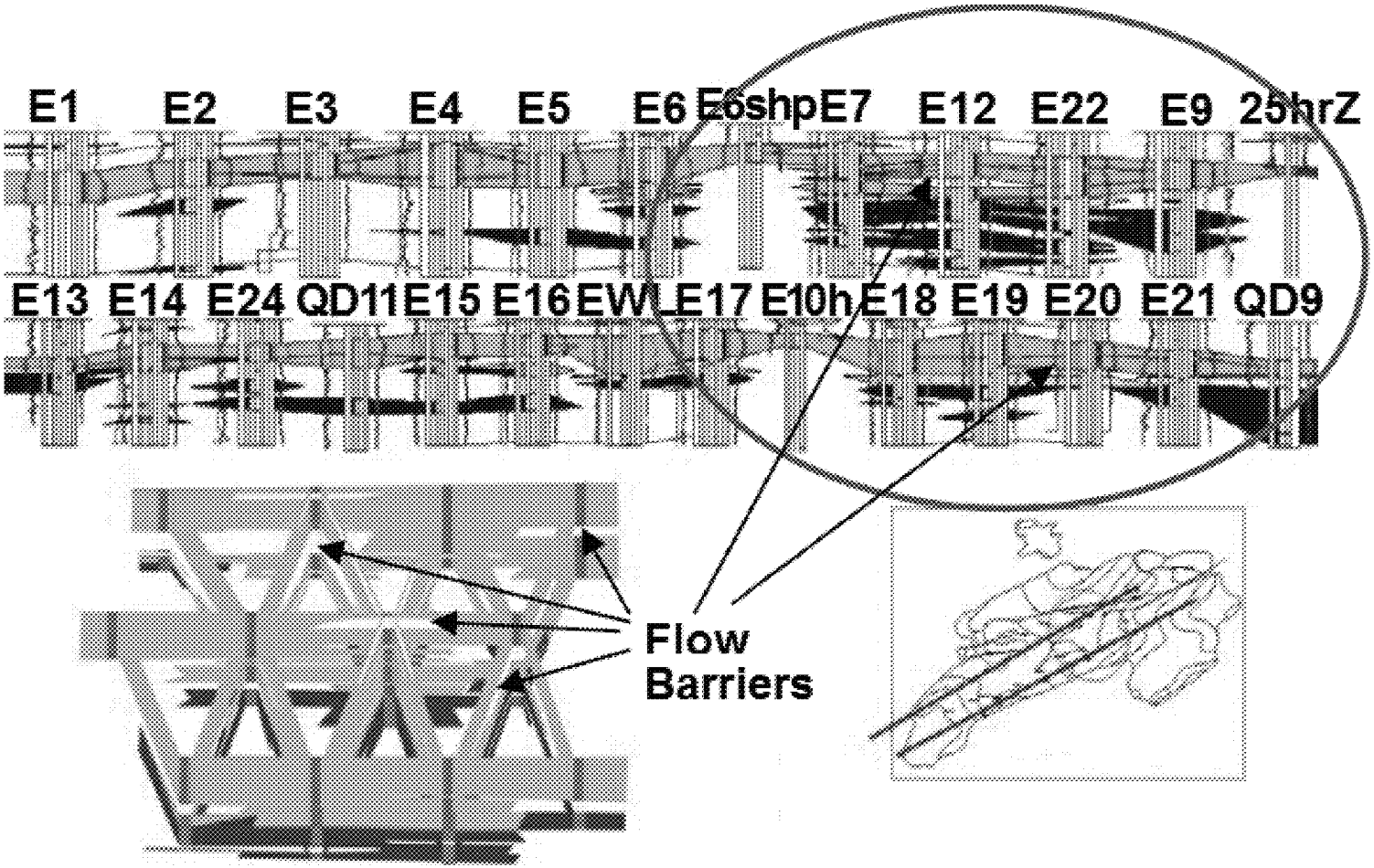
Figure 20:
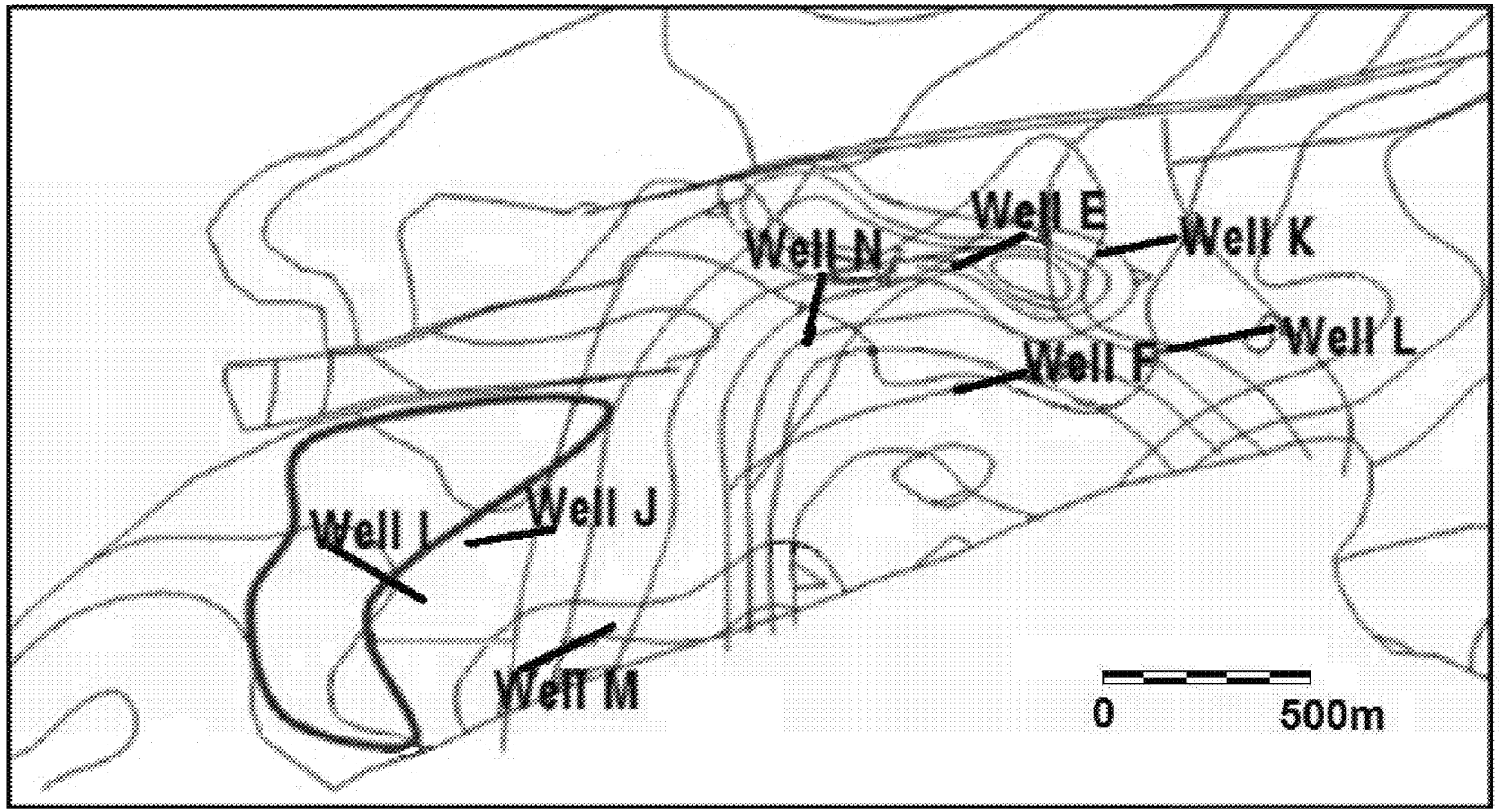
Figure 21A:
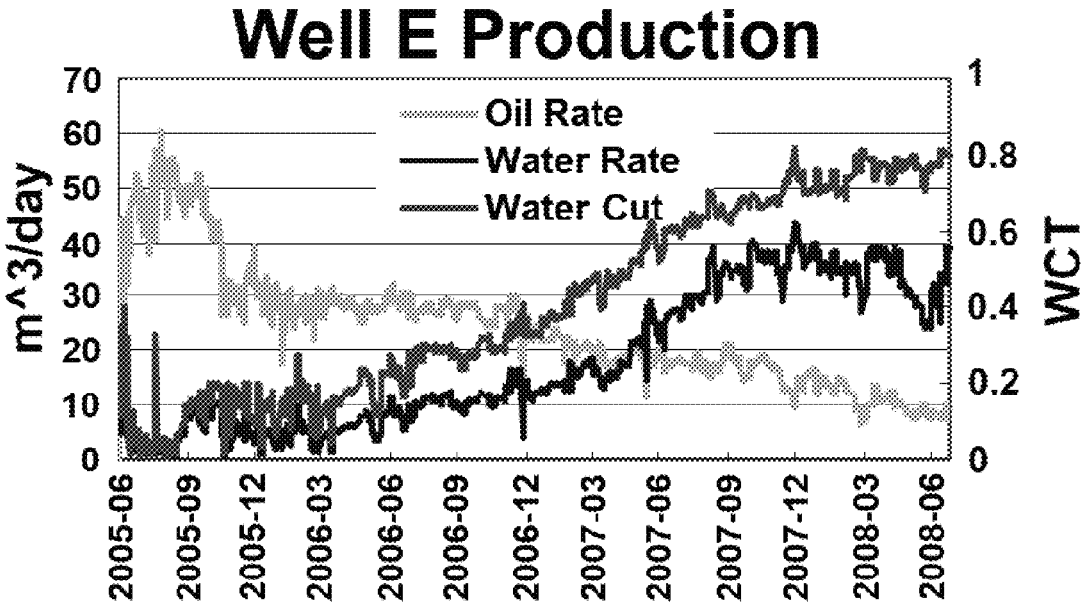
Figure 21B:
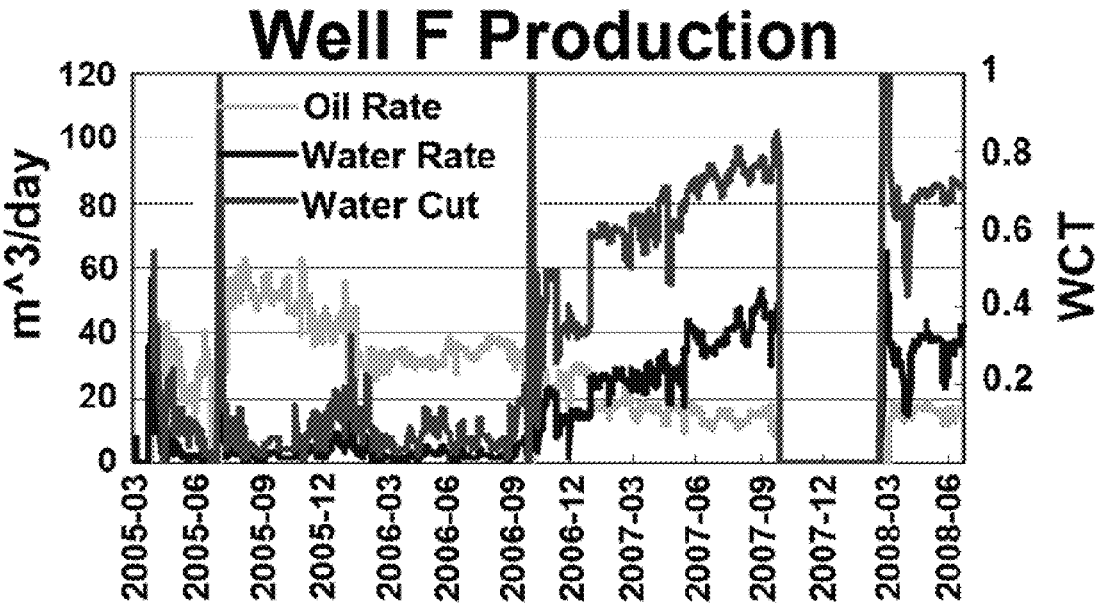
Figure 22A:
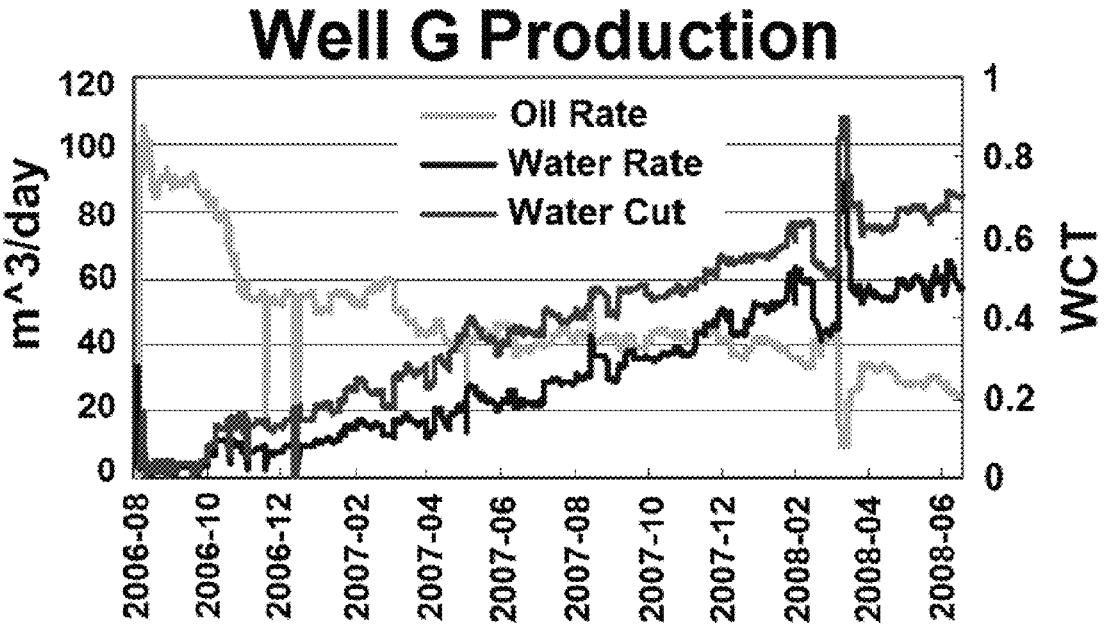
Figure 22B:
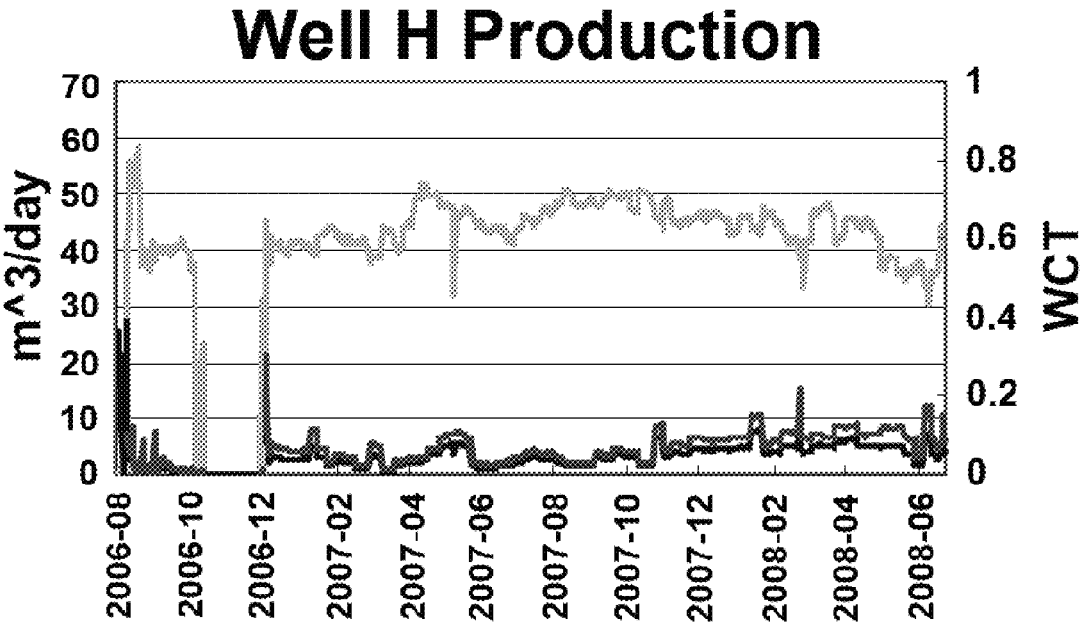
Figure 23:
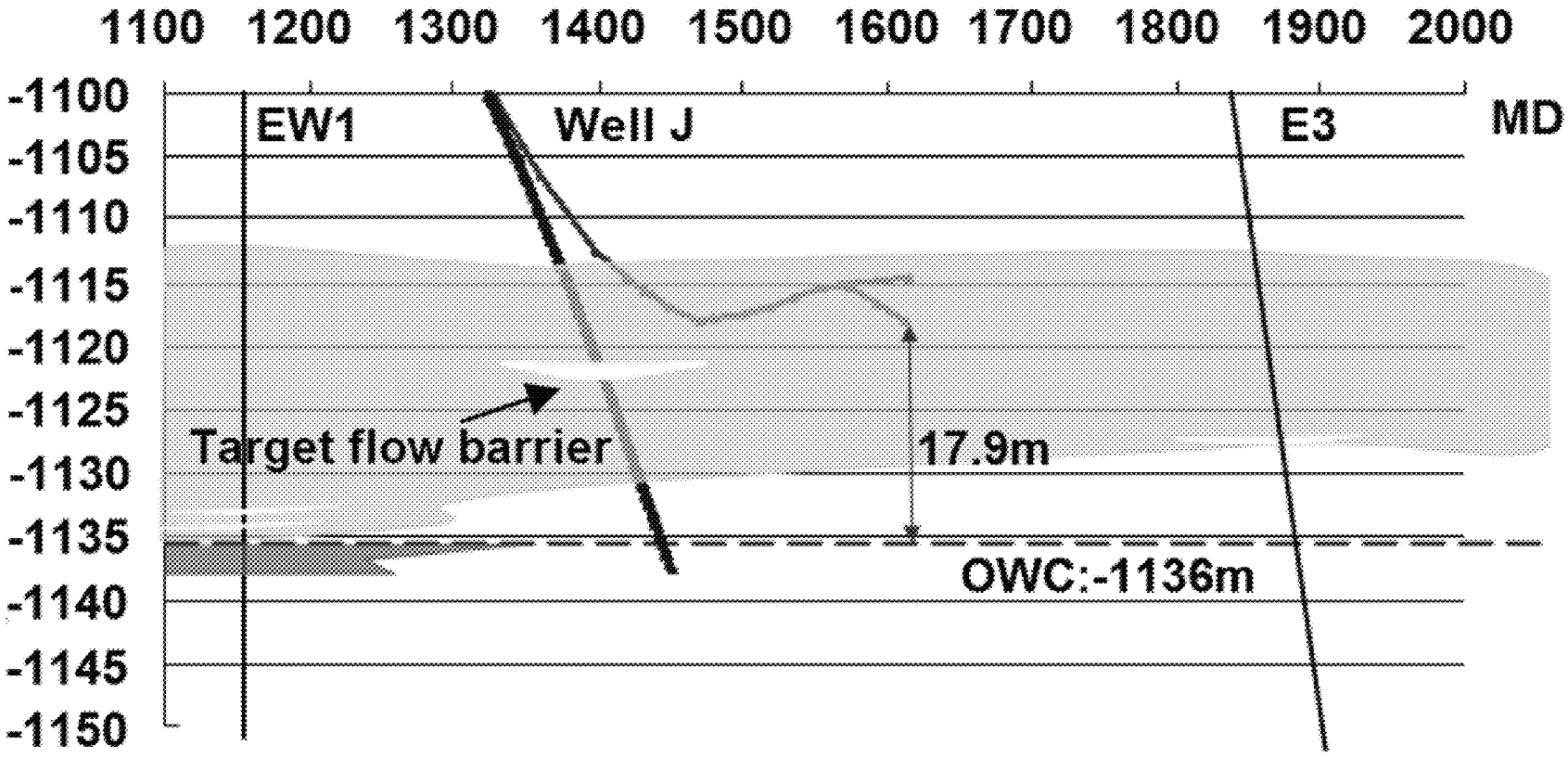
Figure 24A:
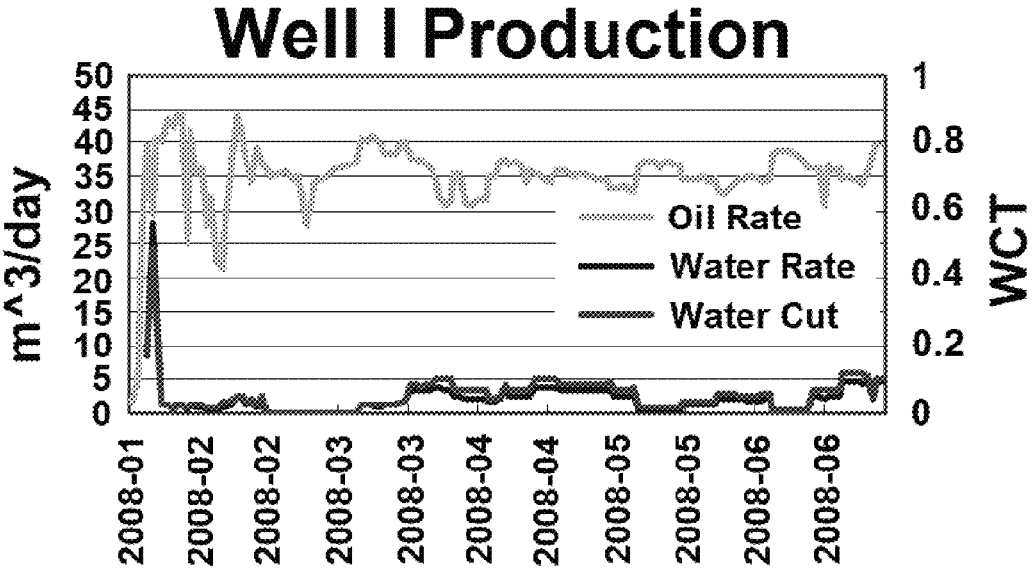
Figure 24B:
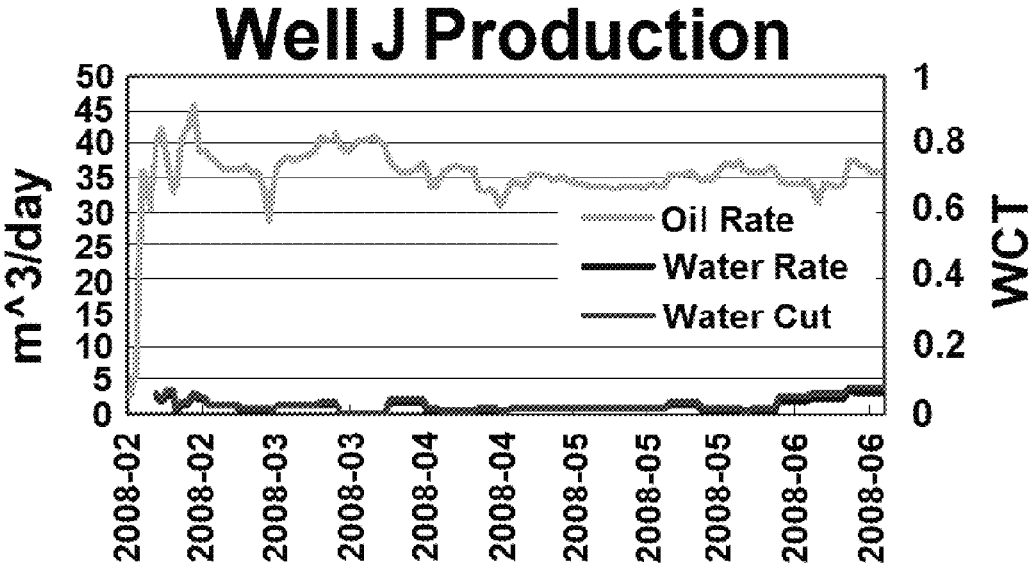
Figure 24C:
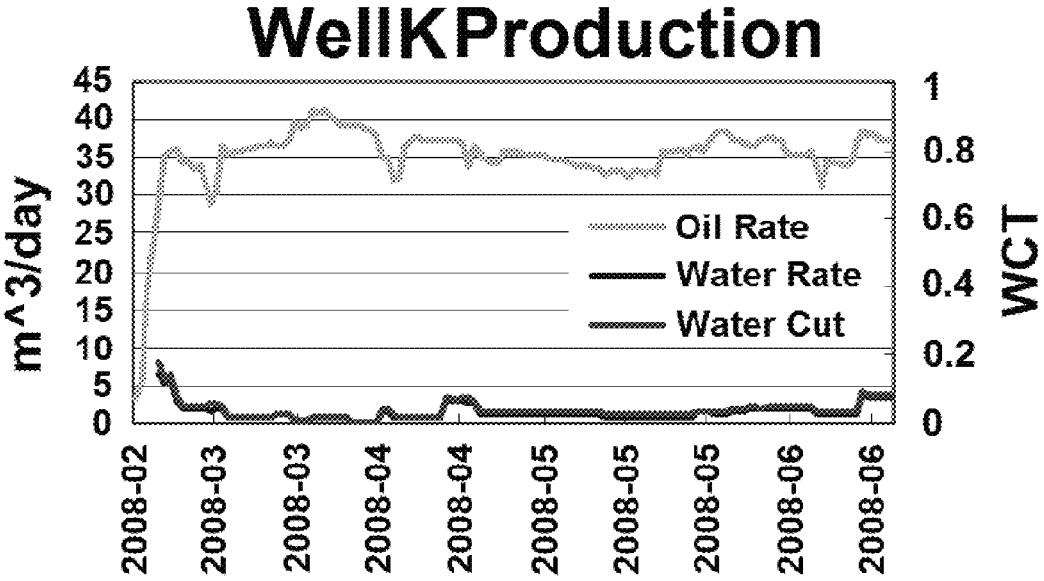
Figure 24D:
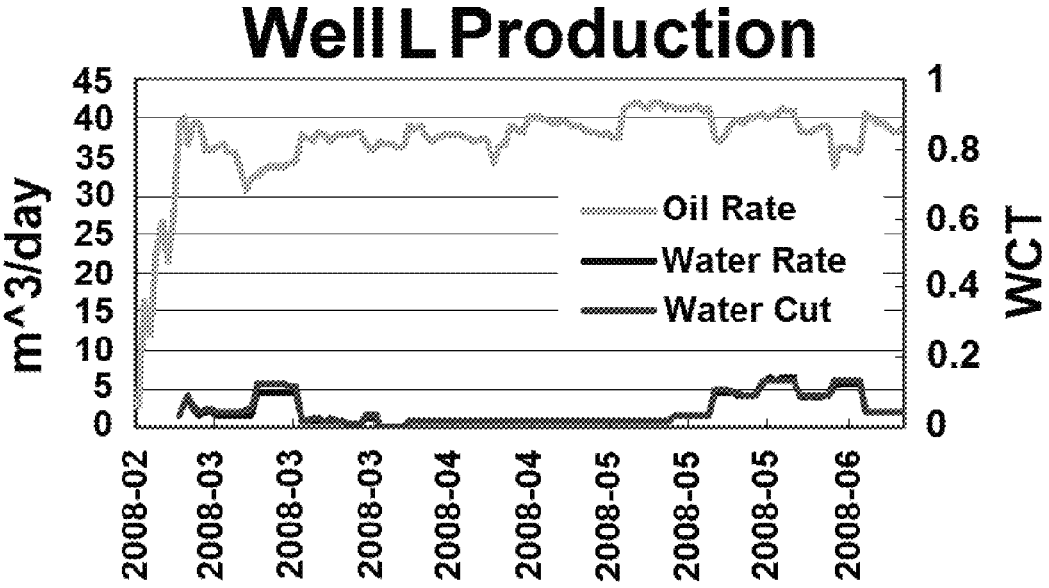
Figure 24E:
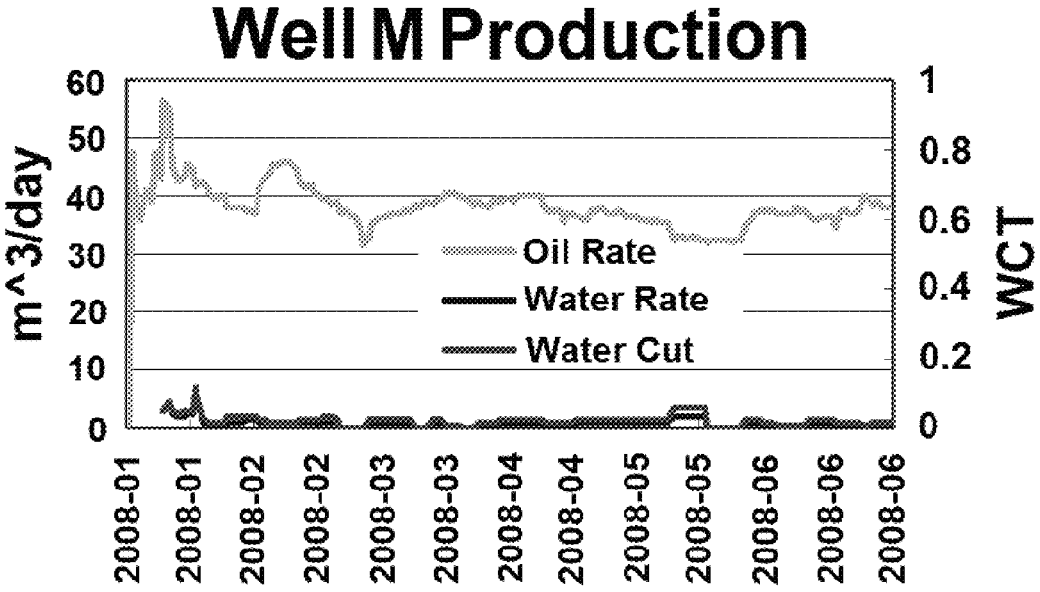
Figure 24F:
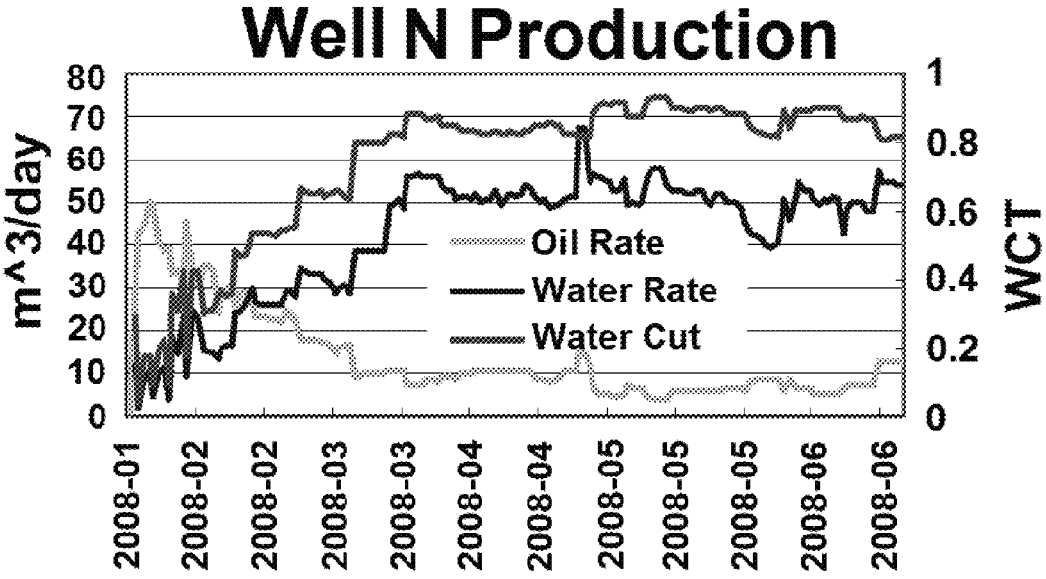
Figure 25:
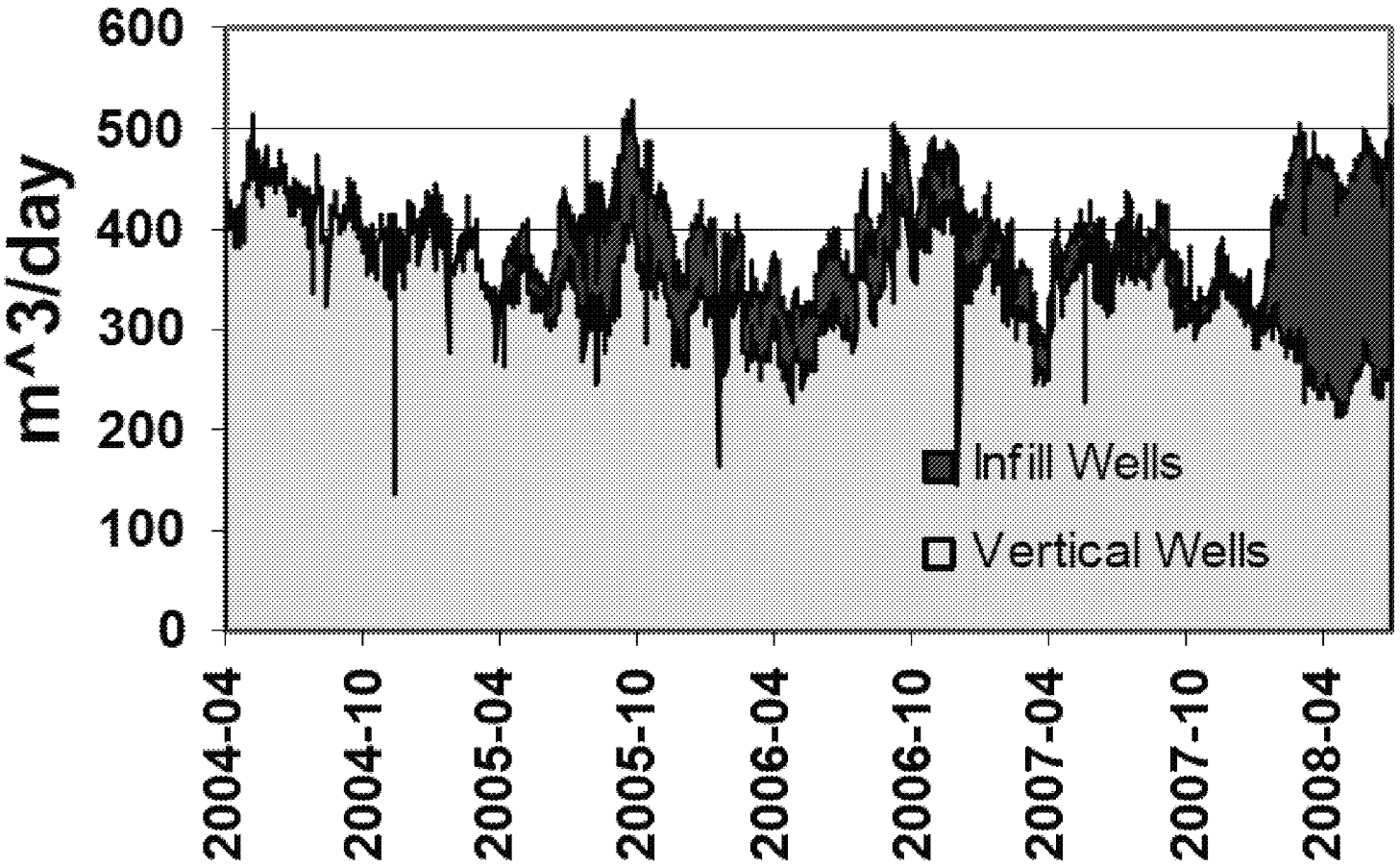

FIGS. 8A-B are schematic views illustrating cross sections of permeability models;

FIG. 9 is a schematic view of flow barrier proportions;

FIG. 10A is a schematic view of well locations;

FIG. 10B is a schematic view illustrating cross sections of wells;

FIGS. 11A-B are schematic views of well production curves;

FIG. 12 is a schematic view of well logs;

FIGS. 13A and 13B are schematic views of geological well models and water/oil contacts;

FIGS. 13C and 13D are schematic views of history matching for the wells shown in FIGS. 13A and 13B;

FIGS. 14A and 14B are schematic views illustrating cross sections of wells;

FIGS. 14C and 14D are schematic views illustrating layers of permeability;

FIG. 14E is a schematic view of low permeability layers;

FIGS. 15A and 15B are schematic views illustrating cross sections of well water saturation;

FIG. 16 is a schematic view of production curves;

FIG. 17 shows steps of a method for optimizing well production in reservoirs having flow barriers;

FIG. 18 is a block diagram of an example computer structure for use in optimizing the location of wells in a subsurface formation having flow barriers;

FIG. 19 is a schematic view illustrating cross sections of wells having flow barriers;

FIG. 20 is a schematic view of well locations and a contour map of flow barriers;

FIGS. 21A and 21B are schematic views of production curves;

FIGS. 22A and 22B are schematic views of production curves;

FIG. 23 is a schematic view of a proposed pilot hole drilling, in accordance with the present invention;

FIGS. 24A-24F are schematic views of production curves;

FIG. 25 is a schematic view of production curves.

Figure 26:
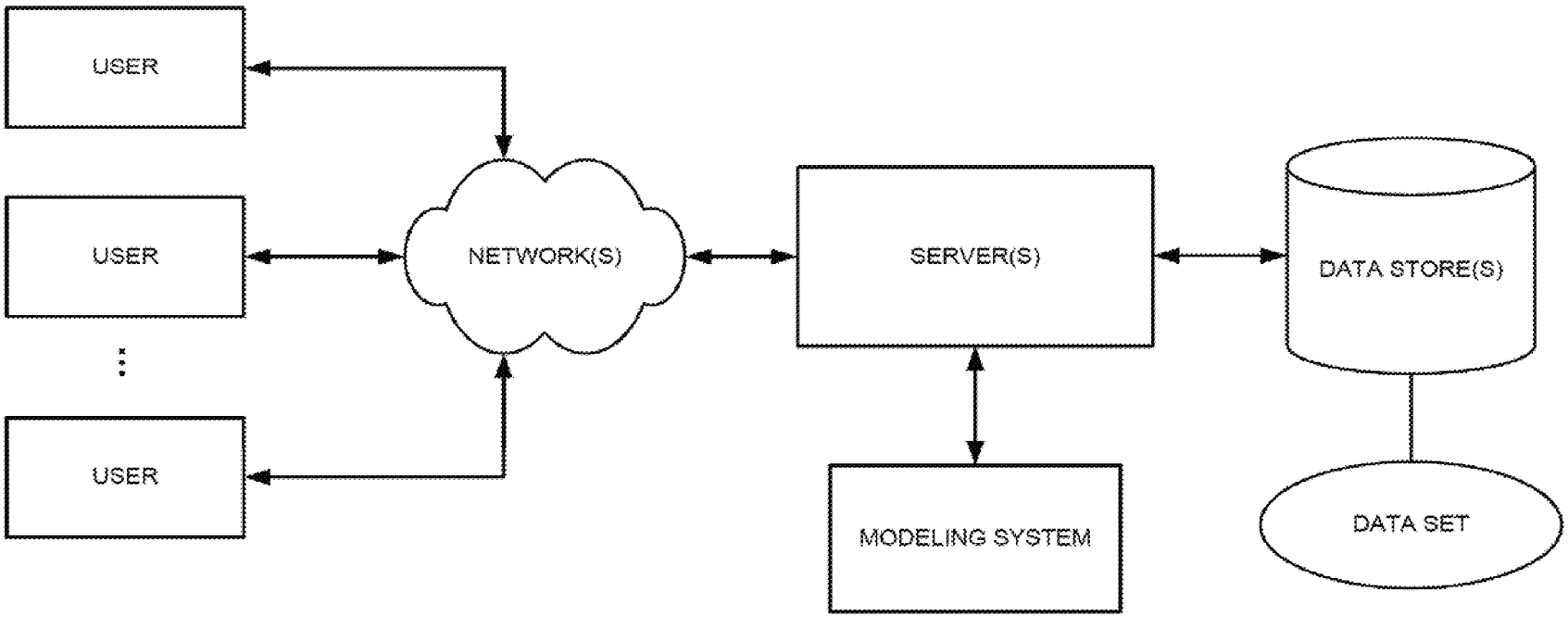

FIG. 26 illustrates an example of a computer system for implementing one or more steps of the methods disclosed herein.

6. DETAILED DESCRIPTION

Systems and methods are provided for use in optimizing the location of horizontal wells in a subsurface formation having flow barriers for use in optimizing hydrocarbon recovery from the subsurface formation, including subsurface formations having bottom water or edgewater. It will be readily apparent to those skilled in the art that description herein in connection with bottom water reservoirs can also be applicable to edgewater reservoirs. A system and method can be configured to use data indicative of by-pass oil areas in the subsurface formation to optimize the location of horizontal wells. The data can be obtained from one or more reservoir simulations of the subsurface formation. Flow barriers in the subsurface formation can be identified from, e.g., well logs of the subsurface formation based on the by-pass oil areas identified by the reservoir simulations. The well logs comprise measurements (versus depth or time, or both) of one or more physical quantities of materials in or around a well. The systems and methods can be used to optimize hydrocarbon recovery from the subsurface formation when fluids comprising hydrocarbons are produced from at least one of the horizontal wells.

Given that water coning characteristics and thus the performance of horizontal wells in bottom water reservoirs or egdewater reservoirs can be difficult to predict, high resolution reservoir models explicitly representing flow barrier distributions can be used. If they are not employed, the impact on the flowing well behavior can vary significantly for different realizations of the simulated model. Higher resolution reservoir models can be used to define parameters that are used to represent the flow barriers accurately. Some of these parameters include, but are not limited to gravity contrast, mobility ratio, vertical permeability, permeability contrast of flow barrier to surrounding reservoir, distance to water/oil contact, length of horizontal well, dimensions and distribution of flow barriers. The computations or simulations disclosed herein can be performed by a reservoir simulator or other computation methods known in the art. The reservoir simulations disclosed herein can be performed on, e.g., a computer that can receive data indicative of physical properties associated with materials in the subsurface formation and perform one or more reservoir simulations for identifying "by-pass" oil areas. The "by-pass" oil areas may arise, e.g., where injected water or gas creates preferential flow-paths that by-pass oil in less permeable portions of the earth formation. For example, gas may by-pass into areas of lower pressure. Earth formation properties or parameters, such as the porosity and permeability, may affect the water flow-path, and result in "by-pass" oil areas. Also, the "by-pass" oil area may arise due to lack of existing producing wells exacting oil from this area, or lack of injecting wells pushing oil out of this area.

A synthetic single-well numerical model can be used to indicate the impacts of reservoir geology on horizontal well performance, and more specifically on the impacts of flow barriers on horizontal well performance in thin strong bottom water drive reservoirs. The synthetic model has a grid of 60×60×32 with cell size of dx=dy=20 m, dz=0.5 m for layer 1-31, and dz=10 m for aquifer layer 32. The distribution of flow barriers can be generated by indicator simulation with the following control parameters: proportion of flow barriers ranges from 5-20%, lateral correlation length ($\lambda_x=\lambda_y$) of flow barrier from 100-400 m. An assumption of no vertical correlation can be made. A total of seven cases are studied with different flow barrier proportions, sizes and permeability contrast with the background sands (see Table 1).

TABLE 1

| | Proportion of flow barriers | Correlation length of flow barriers | Permeability of flow barriers |
|---|---|---|---|
| Case 1 | 20% | 200 m | 10 md |
| Case 2 | 10% | 200 m | 10 md |
| Case 3 | 5% | 200 m | 10 md |
| Case 4 | 10% | 400 m | 10 md |
| Case 5 | 10% | 100 m | 10 md |
| Case 6 | 10% | 200 m | 1 md |
| Case 7 | 10% | 200 m | 20 md |

Figure 1A:
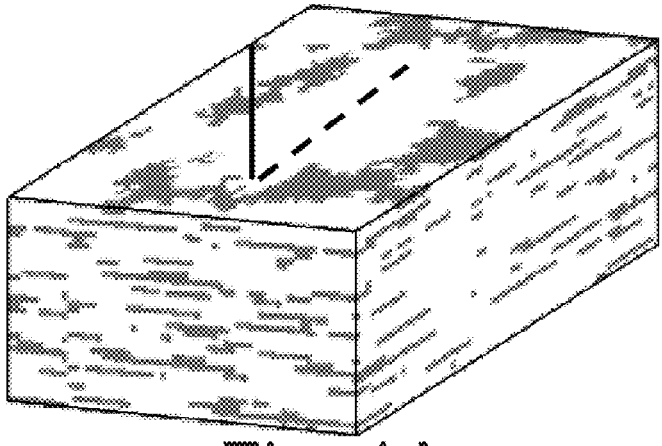
Figure 1B:
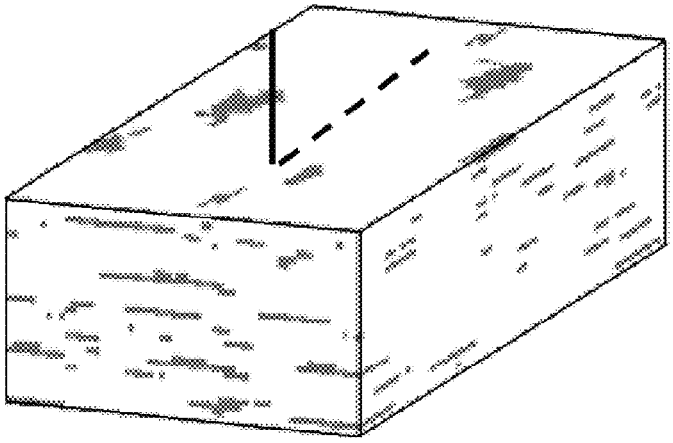
Figure 1C:
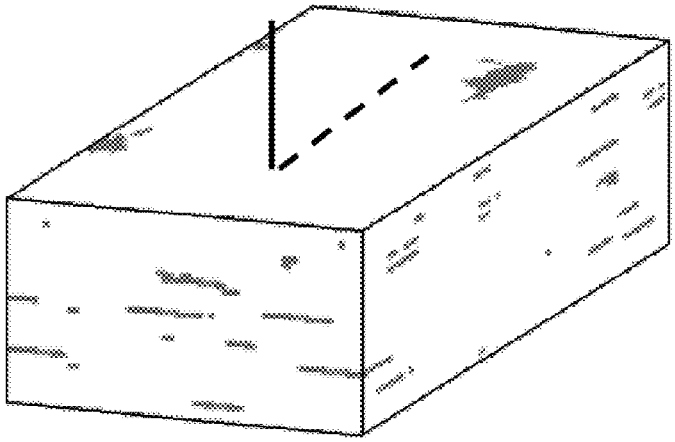
Figure 1D:
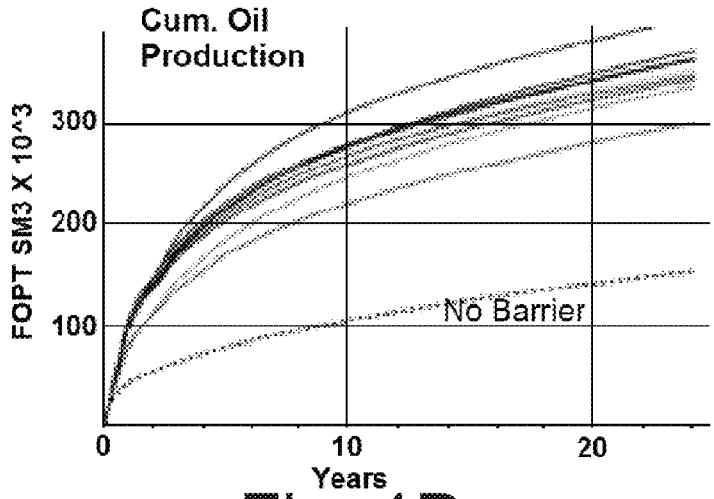
Figure 1E:
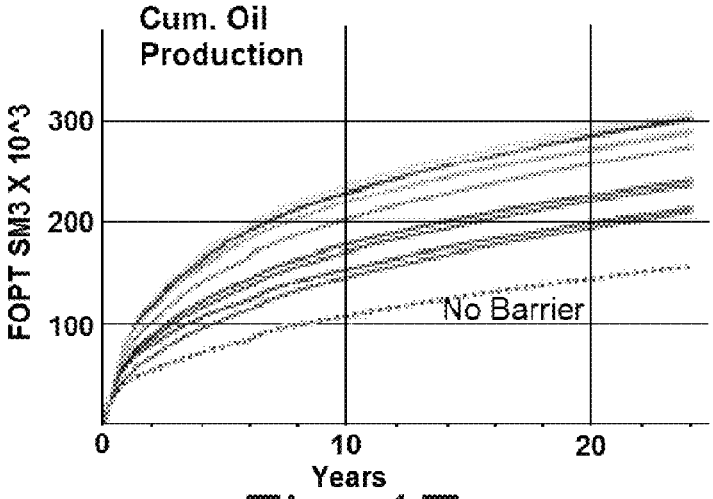
Figure 1F:
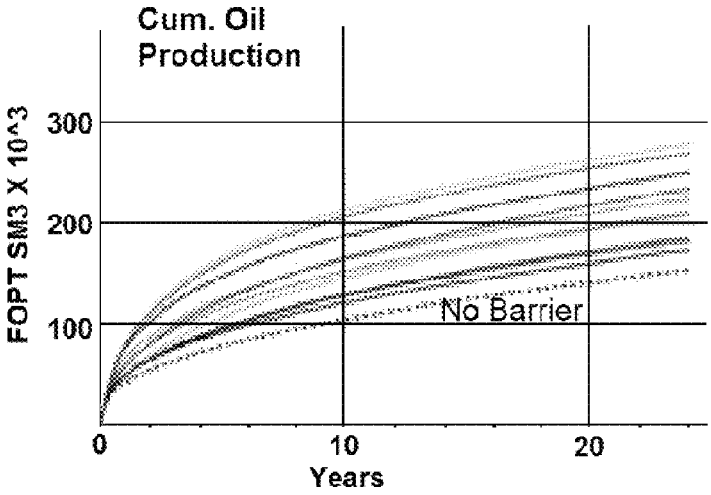

FIGS. 1A-C show one realization of the reservoir model generated with different proportions of flow barriers and the corresponding cumulative oil production of 25 years from 10 realizations of each case compared to the result from a model without flow barriers. FIG. 1A shows Case 1 having a 20% proportion of flow barriers, FIG. 1B shows Case 2 having a 10% proportion of flow barriers, and FIG. 1C shows Case 3 having a 5% proportion of flow barriers. FIGS. 1D-F show the corresponding cumulative oil production respectively for each case. The permeabilities (k) of background sand are assumed constant with values of 2,000 mD for all cases. Porosity and $k_v/k_h$ can be assumed to be 0.2 and 32% for all cells. A horizontal well can be placed in the middle of the model at layer 5 from the top, which is about 12.5 m above water/oil contact, and along the x-direction with horizontal section length of 680 m. The bottom layer is an aquifer layer with strong aquifer strength by using a large porosity multiplier. Oil properties similar to that found in reservoirs in eastern China can be used: viscosity=22 cp, API gravity=25 degree.

The horizontal well is producing with a fixed liquid rate and the well performance is simulated for 10 realizations for each case using a commercial flow simulator. Wellbore friction can be accounted for during the simulation. Multiple realizations can be used in order to obtain more meaningful conclusions by accounting for the possible spatial flow barrier distributions. One skilled in the art will recognize that a large number of realizations may be required for an accurate invariant set of statistical data. FIGS. 1D-F compare the 25 year cumulative oil production from the well to the case without flow barriers.

Figure 2A:
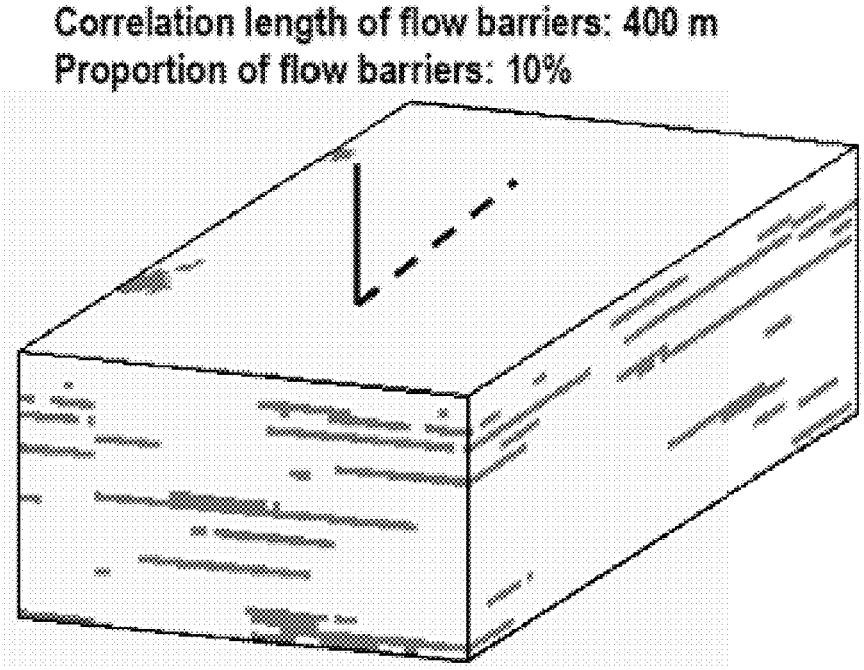
Figure 2B:
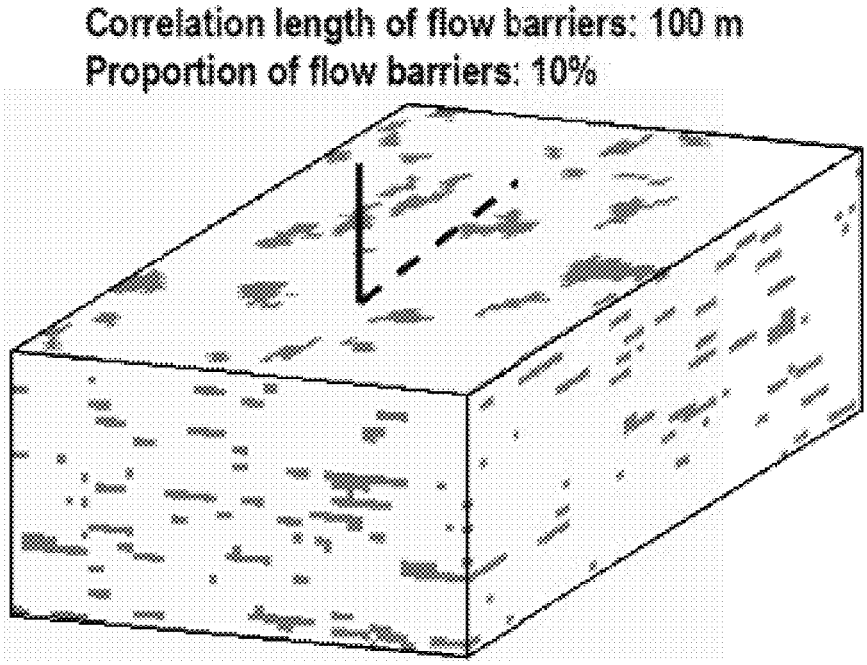
Figure 2E:
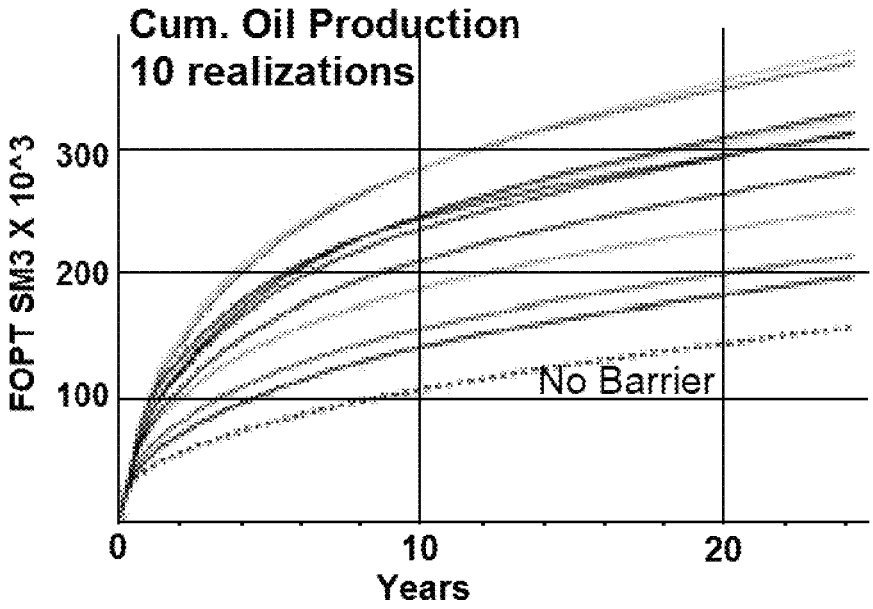
Figure 2F:
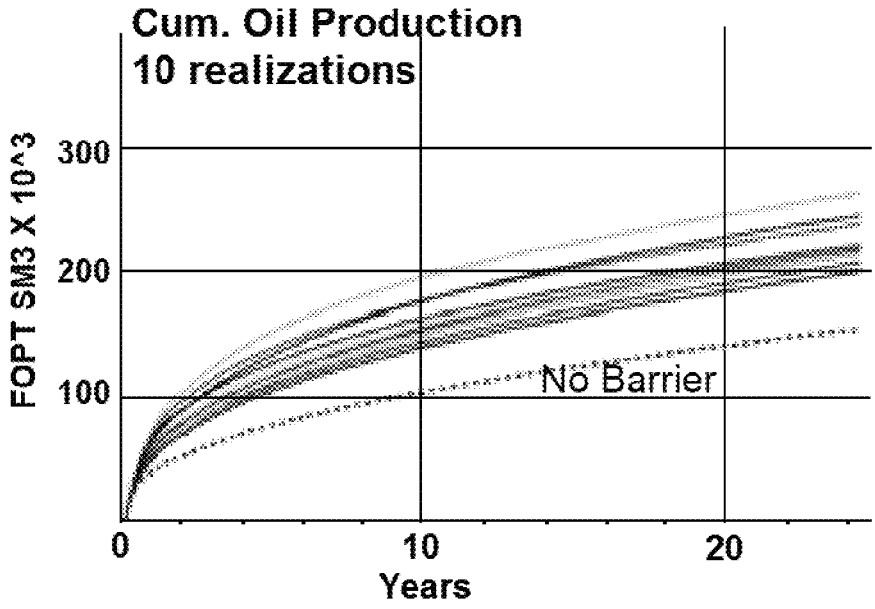
Figure 2G:
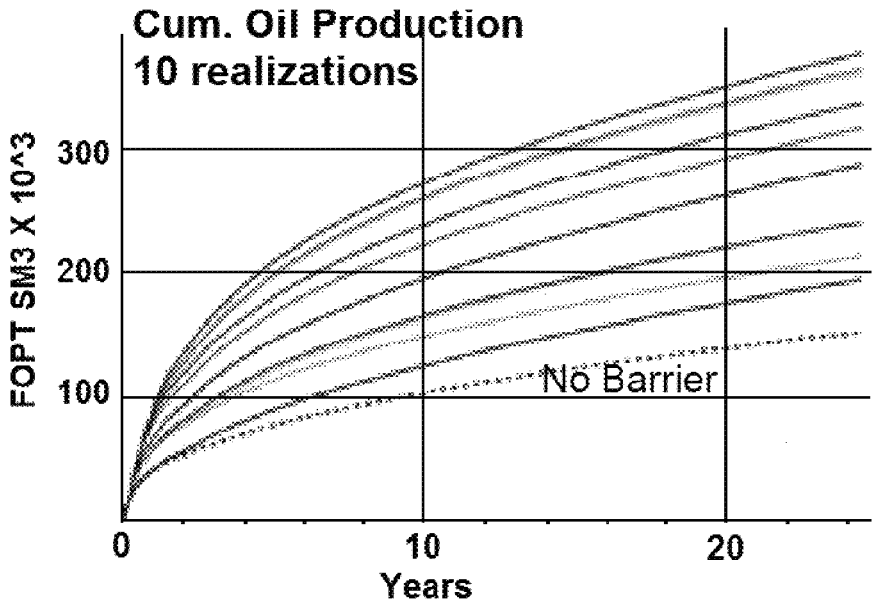
Figure 2H:
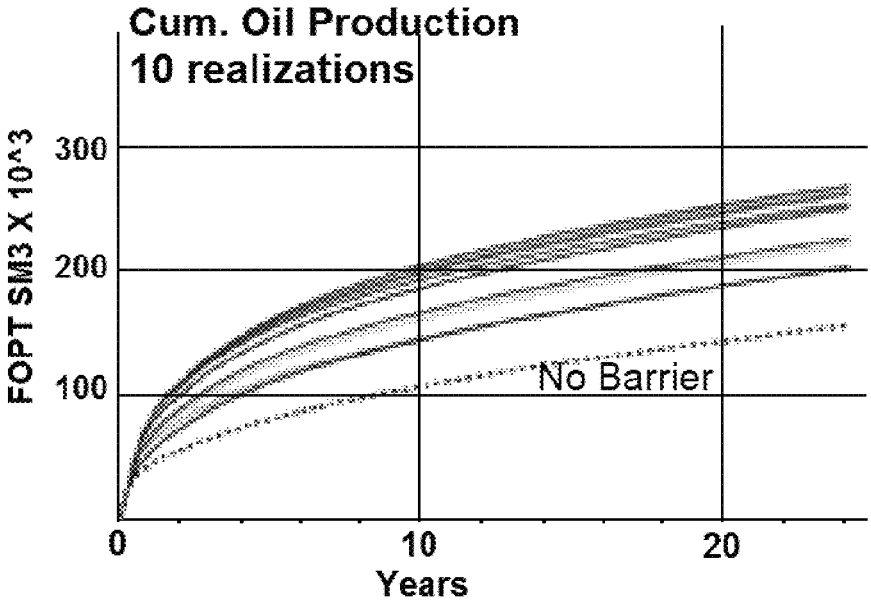

FIGS. 2A-C show one realization of the reservoir model with different correlation length of flow barriers (400 m and 100 m), the predicted cumulative oil production of 10 realizations, as well as the predictions with different permeability values of flow barrier (1md and 20md). In particular, FIG. 2A shows Case 4, FIG. 2B shows Case 5, FIG. 2C shows Case 6, and FIG. 2D shows Case 7. FIGS. 2E-H show the corresponding cumulative oil production respectively for each case. For all cases, the existence of flow barriers can significantly improve oil production of horizontal wells. More specifically, as seen in FIGS. 1A-F, higher proportion of flow barriers yield higher cumulative oil production. Additionally as seen in FIGS. 2A-H, larger lateral extension of flow barriers (in terms of larger correlation length) yield better production performance, but also with larger variations in performance for different realizations. Furthermore, smaller shale permeability results in better production performance, but also with larger variation in performance for different realizations.

The existence of flow barriers increases water travel paths from aquifer to horizontal well, resulting in the slow down of water coning and increase of swept areas. Variations of performance from realization to realization can be relatively large when the correlation length of flow barriers or permeability contrast between flow barriers and background sand is large. This indicates high sensitivity of well performance on the spatial distribution of some "key" flow barriers relative to the well location. One skilled in the art will recognize that the well performance can change to worse if correlation length or proportion of flow barriers becomes too large (e.g., to a degree that might cause pressure communication problem).

Figure 3:
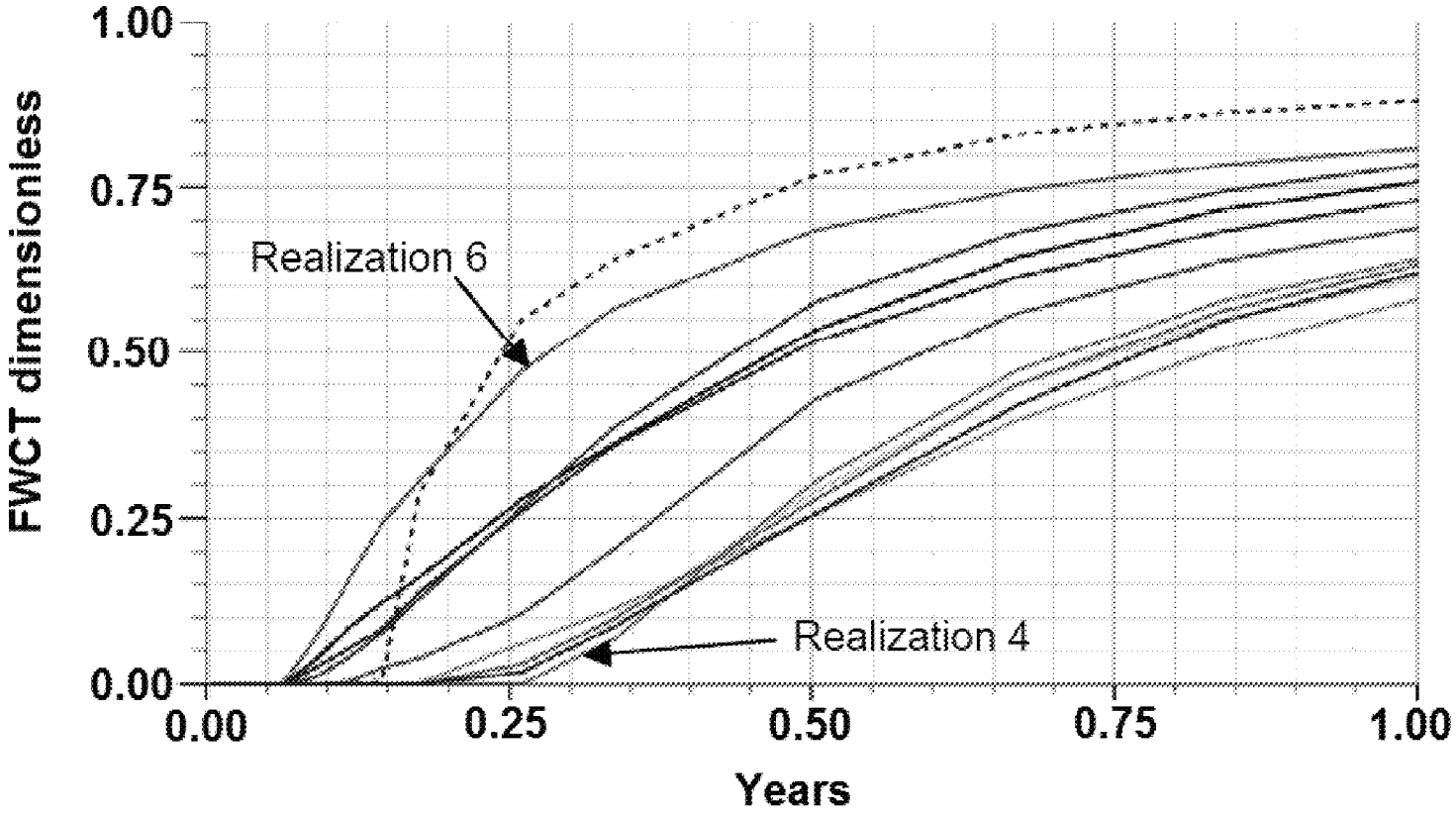
FIG. 3 is a schematic view of water cut curves.
Figure 4:
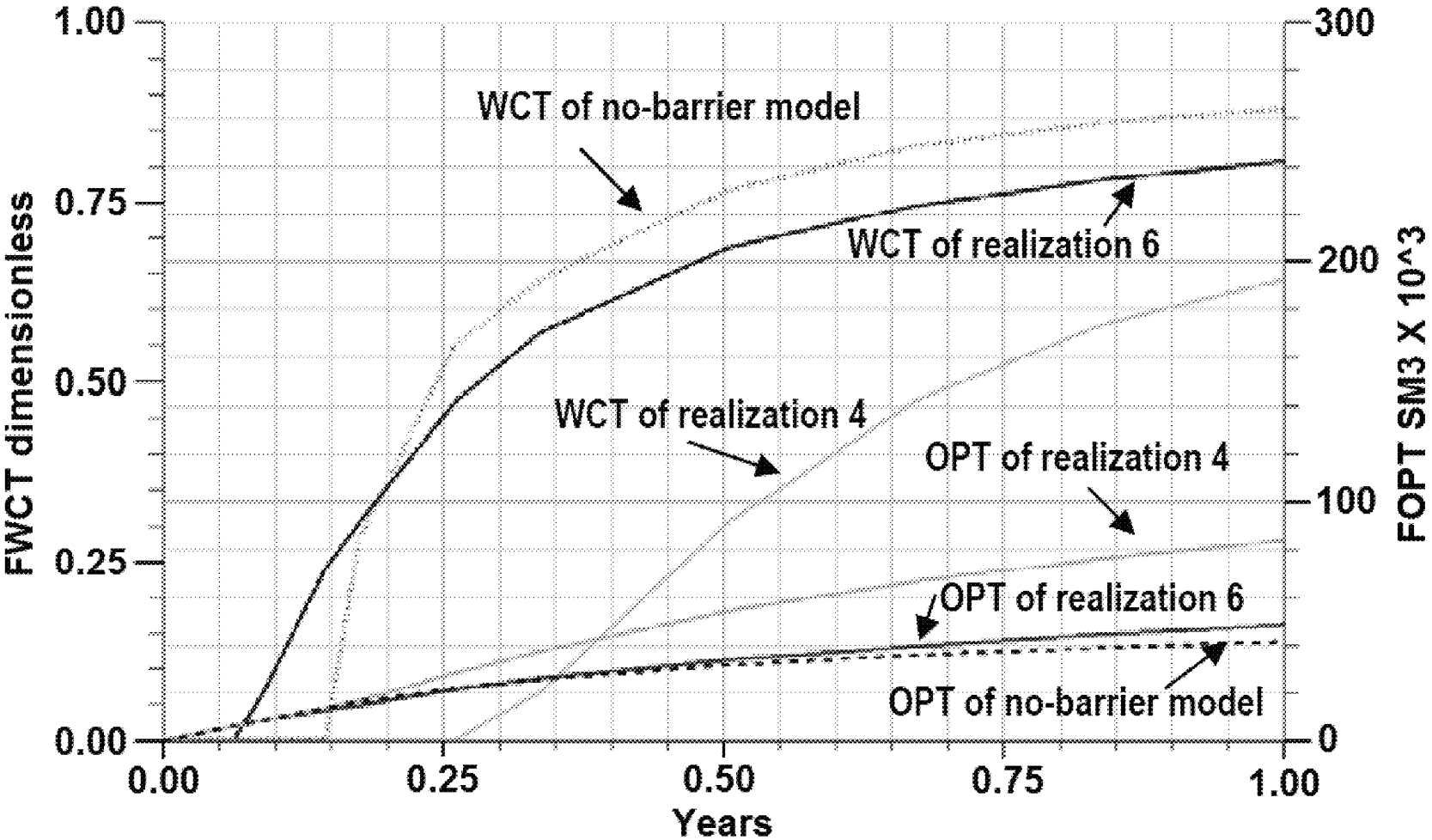
FIG. 4 is a schematic view of water cut curves and cumulative oil production.

FIG. 3 shows the first year water cut curves of 10 realizations from Case 2, which will be used as the base case. The existence of flow barriers can either speed up or slow down the water breakthrough time depending on the realizations (i.e., spatial distributions of flow barriers with respect to the well paths). However, the subsequent rise in water cut after water breakthrough can be typically slower when there are flow barriers in the model. The water cut and cumulative oil production for the first year from a "good" and a "bad" realization are shown in FIG. 4. A "good" realization can be defined as the one with longest water breakthrough time or in this case realization 4 of FIG. 3. A "bad" realization can be defined as the one with shortest water breakthrough time or in this case realization 6 of FIG. 3. The results in FIG. 4 demonstrate that better oil production is attainable for the model with flow barriers even though water breakthrough could be significantly faster, mainly because of the slower rising of water cut from the models with flow barriers than that without flow barriers.

Figure 5:
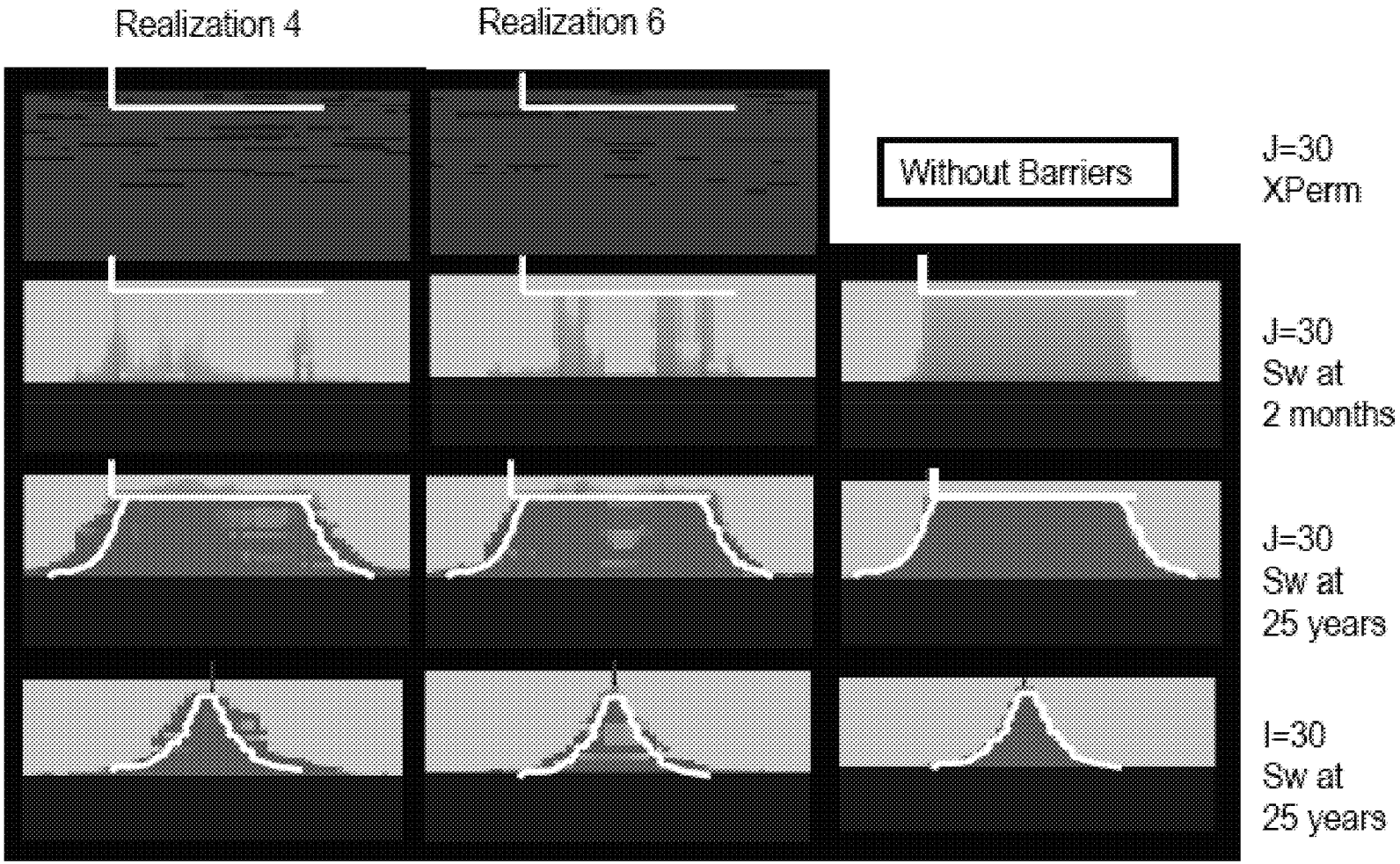
FIG. 5 is a schematic view illustrating cross sections of permeability models.
Figure 6:
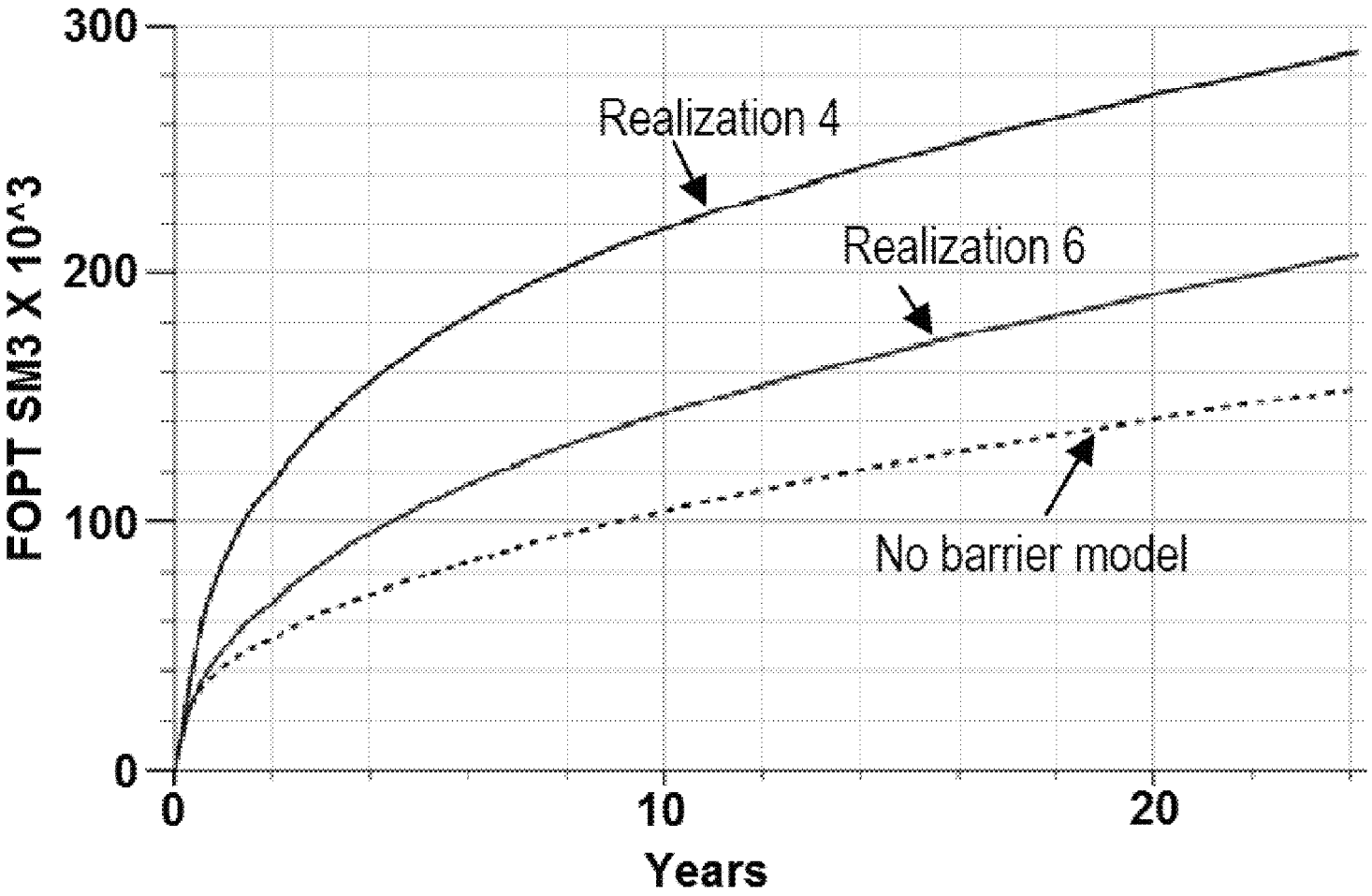
FIG. 6 is a schematic view of cumulative oil production.

In order to further investigate the water cresting characteristics in the models with and without flow barriers, the variation of water saturation with time at the areas underneath the well path can be considered. FIG. 5 shows cross sections of permeability models, as well as, distributions of water saturation at different times from realizations 4 and 6, which are compared to those from the model without flow barriers. The different features of water cresting are apparent. For the model without flow barriers, early water coning occurs for the entire horizontal section, while for the models with flow barriers, water breakthrough could occur either much later in realization 6 or much earlier in realization 4. But in both circumstances, water coning occurs only at a small portion of the horizontal section. Most parts of horizontal well section do not experience water coning after a considerably long period of time. One skilled in the art will recognize that flow barriers can practically shelter some parts of the horizontal section from water advancement. This can explain why the water cut increase in the models with flow barriers can be slower than in the model without flow barriers even though water breakthrough may be quicker in the models with flow barriers than in the model without flow barriers. Thus, for bottom water reservoirs, the water coning characteristics of a horizontal well can be more likely similar to edge water reservoirs when there exist flow barriers. In addition, FIG. 5 shows that the swept areas between horizontal section and water/oil contact are apparently bigger for models with flow barriers than without flow barriers. This might be due to the flow barriers acting as obstacles for vertical flow towards the wellbore, thus the streamlines of vertical flow can be detoured around the flow barriers resulting in sweeping a wider area. FIG. 6 shows that the recovery factor (or cumulative oil production) can be higher for models with flow barriers than without barriers. The cumulative oil production after 25 years from a "bad" realization (realization 4) is still 32% higher than the model without flow barriers, while a "good" realization (realization 6) is 87% higher for cumulative oil production after 25 years.

Figure 7A:
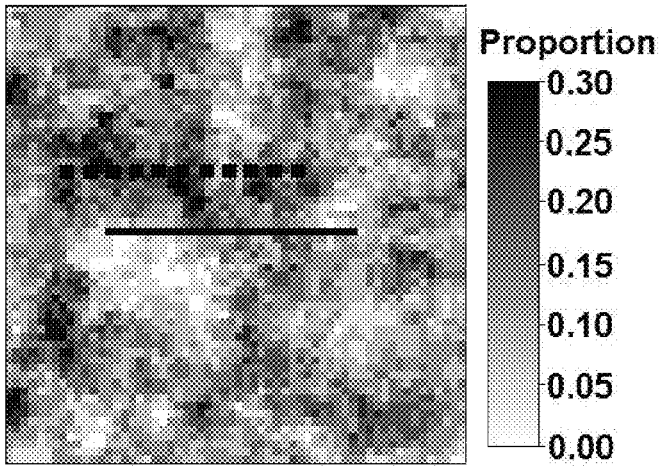
FIG. 7A is a schematic view of flow barrier proportions.
Figure 7B:
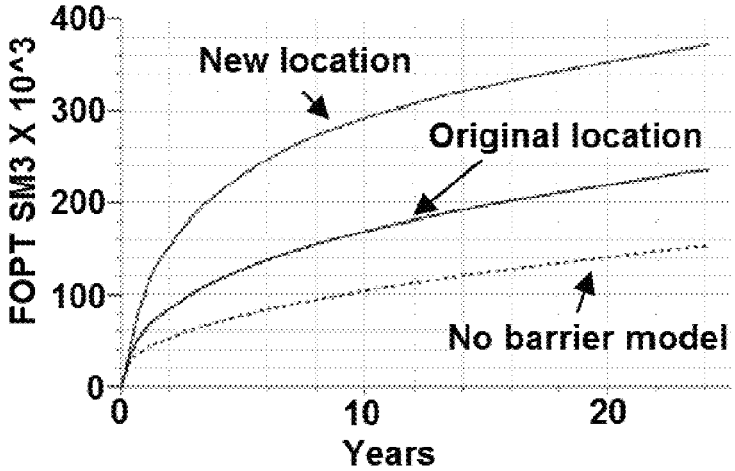
FIG. 7B is a schematic view of cumulative oil production.
Figure 7C:
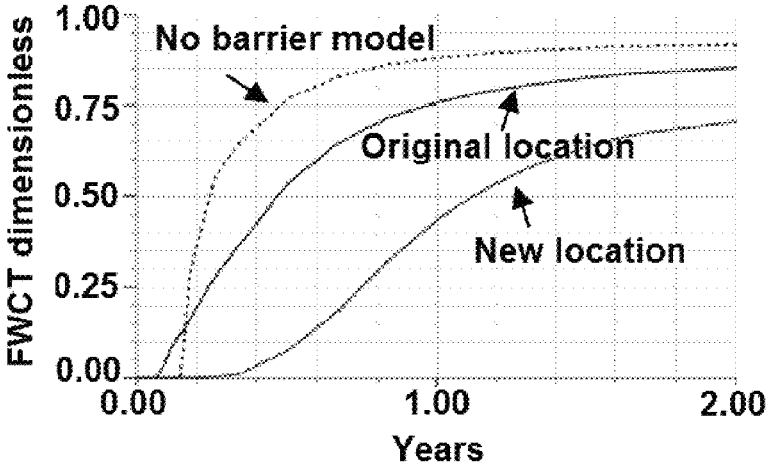
FIG. 7C is a schematic view of water cut.

For a given realization or model, the spatial distribution of flow barriers is known and the vertical proportion/fraction map of flow barriers can be computed. The vertical proportion/fraction map of flow barriers can be spatially varying. Examining the correlation between the production performance and proportion of flow barriers at well locations, it can be shown that a well would perform well if its horizontal section is placed in the area where flow barriers proportion between well path and water/oil contact is high. In order to illustrate this, the vertical proportion of flow barriers from layer 6 (horizontal well is placed at layer 5 in our model) to layer 31 (below which water/oil contact is located) for realization 3 of Case 2 is computed. The result is shown in FIG. 7A. The grey scale in a given (i, j) cell of this figure indicates the value of vertical proportion of flow barrier computed from the 26 layers (from layer 6 to 31) of the same (i, j) cell. For example, at the upper left corner cell (1, 1), flow barriers are found in only 1 layer from the 26 layers (from layer 6 to 31), thus the vertical proportion of flow barrier in cell (1, 1) is $1/26=0.04$. The original horizontal well is placed in the middle of this model (the solid line) where the proportion of flow barriers is relatively small, particularly in the heel (left) side. This can lead to relatively poor production performance with only 54% increase for cumulative oil production compared to the model without flow barriers. The horizontal well upper left is moved to the location indicated by the dash line and the well performance is recomputed. The results are shown in FIGS. 7B and 7C, where it can be seen that the production performance of newly located well can be significantly better than the original well location with 140% increase of oil production over 25 years compared to the model without flow barriers.

FIGS. 8A-B show the cross sections of permeability and water saturation at different time which reveals the beneficial impact by moving the well location from the original place (FIG. 8A) to a new location (FIG. 8B). More flow barriers can be seen in the cross section of new well location than in that of original well location, which can result in much later water breakthrough, slower water cut increase, and higher oil production from the new well. Similar effects are obtained for realizations 6 and 7 by moving the well location to new places as indicated in FIG. 9. For the both models, the cumulative oil productions over 25 years from the original wells are about 40% more than that from the model without flow barriers, while the wells at new locations produce 90% more oil compared to the model without flow barriers.

In view of the foregoing, well locations can be optimized using the vertical proportion map of flow barrier or, in other words, to place the well at the area with a higher proportion of flow barriers. As for the vertical direction, the horizontal section can be placed as far from the water/oil contact as possible so that there are more chances of encountering flow barriers and higher stand-off distance from the water/oil contact. The optimal normalized stand-off, z/h, where z is the stand-off distance and h is the total oil column height from reservoir top to water/oil contact, can be in the range of 0.7-0.9. Furthermore, it may be advantageous to drill long horizontal wells to gain more contact areas as the pressure drop along the wellbore can be small for the given wellhole size and production rate used in the simulations.

Regarding field verification of the effect of flow barriers effect on well production, the following are discussed. The reservoir geology and the flow barriers can impact the production performance and water cresting characteristics of horizontal wells in bottom water reservoirs. The existence of discontinuous flow barriers improves the production performance of horizontal wells by delaying the water breakthrough and slowing down the water cut rising. Part of the horizontal section can be shielded from rising water crest by flow barriers, while water cresting can occur to the entire horizontal well when there is no flow barrier.

As an example, the geological characteristics and production performance of two horizontal wells from an oil field in Bohai Bay, China are investigated. The reservoir depth for a first producing formation, Field 1, ranges from 1000 m to 1400 m. A second producing formation, Field 2, is at the depth of 1450-1900 m. Field 1 formation is comprised of fluvial depositional reservoirs with meandering channels, multiple sand systems and complex oil/water systems, while Field 2 is a fluvial sand deposition with braided channels and strong bottom water, the oil column height ranges from 10-30 m. Two horizontal wells, Well A and Well B, are drilled in Field 2 formation to test the development efficiency of such reservoir using horizontal wells. Both wells are drilled at structure top locations with very similar geological conditions, as shown in FIGS. 10A-B. The horizontal lengths for the two wells are 713 m for Well A and 999 m for Well B, respectively. The oil column heights (from horizontal section to water/oil contact) are 11 m for Well A and 16 m for Well B. After completion, both wells are operated with similar conditions, that is, similar initial production rate and similar small pressure drawdown. It is thus expected that both wells would have similar production performance. However, the two wells displayed quite different production performance. Well A displayed unstable production at early stage with quick water breakthrough in less than 3 months. In addition, the water cut increased rapidly after water breakthrough reaching 90% in less than one year. Oil production declined from about 200 $m^3$/day to around 30 $m^3$/day within one year, as shown in FIG. 11A. These are the typical production characteristics of a horizontal well in thin bottom water reservoirs. Production from Well B is stable and free of water for more than 8 months. The water cut increased gradually after water breakthrough staying less than 50% for 3 years, as shown in FIG. 11B. The production performance of Well B does not display the characteristics of a typical bottom water reservoir, rather than a typical edge water reservoir.

A study of reservoir characteristics in areas around the two wells, to understand the drastic production performance difference of the two wells, revealed the existence of thin low permeable flow barriers. As described previously herein, thin low permeable flow barriers with limited horizontal extension/continuity between the wellbore and water/oil contact can impact the water coning characteristics. Accordingly, wells with such flow barriers can display later water breakthrough with steady increase of water cut after breakthrough, such as Well B, while wells without such barriers can display quick water coning with water cut reaching more than 90% rapidly, such as Well A.

To further understand the different production performance in Well A and Well B, two nearby appraisal wells, Well C and Well D, are considered. The locations of Well C and Well D are shown in FIG. 10B, such that Well D is close to Well A, while Well C is close to Well B. FIG. 12 shows the logs of these two wells, the gamma ray and permeabilities in Well D are more or less uniform indicating clean sand with high permeability, while in Well C, two low permeability zones can be identified indicating the possible existence of low permeability flow barriers. The reservoir model of Field 2 formation is then constructed and history matched by methods commonly known in the art. FIGS. 13A-D show the reservoir model, water/oil contact and matched well performance for Well A and Well B. The matching of production history in both wells is excellent without significant changes to the original geological model. The permeability distributions of cross sections at Well A and Well B areas from the history matched model are shown in FIGS. 14A and 14B. In FIGS. 14C and 14D the layers with permeability smaller than a threshold value of 29.5 mD (which is about 1% of the average permeability in Field 2 formation) in the two areas can be seen. There exist some low permeable flow barriers between Well B and water/oil contact, while no flow barrier displays in the area between Well A and water/oil contact. In FIG. 14E, the spatial (lateral) extension of some major low permeable layers in Well B area is shown such that the majority of the horizontal section of Well B is well-shielded by several layers of flow barriers and water breakthrough is likely occurring mainly at the section near the heel where only one layer of flow barrier with limited lateral extension is found. FIGS. 15A and 15B shows the cross sections of water saturation calculated in the areas of the two wells. For Well A, water cresting did occur for the entire horizontal section, while in Well B, water coning occurred only at a small portion of the horizontal well section near the heel part. The existence of a significant number of low permeability flow barriers in Well B area ensures the good production performance in Well B with late water breakthrough and slow increase of water cut after breakthrough (water coning occurs only at small portion of horizontal section). While the poor production performance in Well A is mainly due to the clean sand distribution in Well A area resulting in early water breakthrough and fast increase of water cut (water cresting occurs at the entire horizontal section). Therefore, the field data and simulation results in Field 2 formation further verify the difference in production performance between Well A and Well B. One skilled in the art will recognize that some other factors may also contribute to the performance differences of the two wells, such as distance from the water/oil contact, horizontal well length and producing pressure drawdown.

An optimization method is discussed for optimizing horizontal well locations. To fully utilize flow barriers, the spatial distribution of such thin and spatially discontinuous flow barriers can be identified. This can be challenging since thin flow barriers usually can be at sub-seismic scale and thus difficult to characterize before many wells have been drilled. Therefore, long term production tests are helpful to obtain reliable pre-development data on the influence of discontinuous flow barriers for the development of a new or green field. For infill drilling of a mature field where many wells (such as vertical wells) are drilled, it is possible to predict/correlate/characterize the spatial distribution of thin flow barriers from the logs of existing wells. Optimization of horizontal well locations can be performed to make full use of the flow barriers and thus improve production of fluids.

Infill drilling optimization is utilized at Field 1 and Field 2 formations in the west area of the oil field in Bohai Bay, China. The Field 1 formation in the west area is shallower than the Field 2 formation. The main pay sand layer is a bottom/edge water reservoir with oil column of 10-20 m. Oil in Field 1 formation is heavier than in Field 2 formation with viscosity of 260 cp and API gravity of 15-17 degree. Originally, 21 vertical wells were drilled to develop this area and the resulting production performance was poor because of severe water coning problems. Water cut reached 50% in less than one month and current water cut is about 90%, as shown in FIG. 16. Horizontal infill wells can be drilled in this area to improve the production.

The following method, also shown in FIG. 17, can be used to identify potential infill areas and optimize well locations:

(a) using reservoir simulation to identify "by-pass" oil areas;
(b) identifying thin flow barriers (such as, but not limited to, from existing well logs) and predicting/correlating the lateral extension of flow barriers between wells;
(c) placing infill horizontal wells at areas with high remaining oil saturation and flow barriers between the well paths and water/oil contact;
(d) using pilot hole drilling to verify the existence of flow barriers if necessary;
(e) placing horizontal well near the top of the oil column and drilling the horizontal section as long as permitted by the well spacing; and
(f) producing the horizontal well with small drawdown to control the water coning and then increase liquid production rate when water cut is high (e.g., 80-90%).

FIG. 18 depicts a block diagram of an example system for use in optimizing the location of wells in a subsurface formation having flow barriers and bottom water (which can also be applicable to an edgewater reservoir). The system can comprise a well location optimization module 2 for performing the processes discussed herein. In the practice of the system and method, data indicative of by-pass oil areas in the subsurface formation is received at process 4 (such as from a reservoir simulation 8), one or more flow barriers in the subsurface formation are identified based on the by-pass oil areas identified by the reservoir simulation at process 6, and the lateral extension of the identified flow barriers in the subsurface formation are predicted at process 10. The reservoir simulation can receive data indicative of physical properties of materials in the subsurface formation 12 to compute the data indicative of by-pass oil. As shown at process 11 the practice of the system and method can also comprise determining the placement of one or more horizontal infill wells at areas of the subsurface formation based on the predicted lateral extension, and determining placement of at least one horizontal well relative to an oil column of the subsurface formation based on placement of the one or more horizontal infill wells.

The result of the well location optimization can be, but is not limited to, one or more parameters that indicate the location of the one or more horizontal infill wells and/or at least one horizontal well that can provide optimized hydrocarbon recovery from the subsurface formation when fluids, comprising the hydrocarbons, are produced from the at least one horizontal well in the subsurface formation.

The solution or result 14 of the well location optimization can be displayed or output to various components, including but not limited to, a user interface device, a computer readable storage medium, a monitor, a local computer, or a computer that is part of a network.

FIG. 19 shows two cross sections in the west area and the correlation analysis of different pay sand layers, as well as the flow barriers. Three main flow barriers are identified and the lateral extension of these flow barriers is predicted. Two horizontal wells (Well E and Well F) are drilled as a pilot test of infill drilling as shown in FIG. 20. Well E is drilled at 21.5 m from the water/oil contact (the total oil column height is 27 m) with horizontal section length of 312 m. Well F is drilled at 21.7 m from the water/oil contact (the total oil column height is 25 m) with horizontal section length of 313 m. The production performance of these two wells is very positive, as shown in FIGS. 21A-B. Well E produces almost free of water for about one year, and then water cut increases gradually. Current cumulative oil production reaches 27,000 $m^3$. Well F produces pure oil for more than two years, and then with gradual increase of water cut. The current cumulative oil production from Well F reaches 28,500 $m^3$. Both wells display the desired production behaviors similar to Well B, that is, late water breakthrough and particularly slow increase of water cut after breakthrough.

After the successful production in the two pilot horizontal infill wells, two more horizontal wells, Well G and Well H, are drilled in Field 2 formation near Well B area, as shown in FIG. 10A. Additionally, another six wells, Wells I-N, are drilled in Field 1 formation as shown in FIG. 20. The wells are placed above interpreted potential flow barriers with distance of horizontal section to water/oil contact ranging from 11-22 m and length of horizontal section of 170-650 m. The production curves of Well G and Well H are shown in FIGS. 22A-B, which again illustrate good performance behaviors with late water breakthrough and slow increase of water cut. Well H has produced free of water since the beginning.

The flow barrier distribution in the proposed Well J area can be uncertain. To reduce the uncertainty on the existence of flow barriers, a pilot hole can drilled before the horizontal section to check if the predicted flow barrier exists. FIG. 23 shows the interpretation results from the well log of the pilot hole which verifies the existence of flow barrier. Then Well J is drilled as originally designed. FIGS. 24A-F show the production performances of all six newly drilled infill wells. Initial production from these wells shows good performance, except for Well N where water production can be unexpectedly large right after the production started. Such behavior could have been caused by reasons other than reservoirs. The infill drilling program in the west area of the oil field in Bohai Bay, China is shown to be very successful. This demonstrates that the methods of the present invention focusing on the distribution of flow barrier can be appropriate for strong bottom water drive reservoirs. Current production from the 8 infill horizontal wells accounts for almost 50% of total current oil production in Field 1 formation in the west area of the oil field, as shown in FIG. 25.

Following are examples of results of use of the optimization method. The production responses from different wells can display significant variations even though they are operated under similar conditions. Some wells show premature water coning and rapid water cut rising although high quality sands are targeted, while others show much delayed water breakthrough and slower water cut increases. A series of reservoir simulations can be conducted to investigate the observed differences. The simulation results show that the existence of thin low permeable flow barriers with limited lateral extension/continuity between the wellbore and water/oil contact plays a role that impacts the water coning characteristics. Wells with such flow barriers display later water breakthrough with steady increase of water cut after breakthrough, while wells without such barriers show quick water coning with water cut reaching more than 90% rapidly. The existence of low permeability barriers between the water/oil contact and horizontal wells may slow down water coning and result in favorable production performance. This phenomenon is verified by simulations and actual field data from an oil field in Bohai Bay, China. The accurate predictions of production performance use knowledge of physical distribution of flow barriers relative to the wellbore location. In practice, lateral thin flow barriers are usually at sub-seismic scales, and thus hard to identify for a green field. However, for infill drilling in mature fields with many vertical wells drilled, it is possible to predict/correlate the spatial distribution of such flow barriers from the logs of existing wells. Based on such analysis, the locations of horizontal infill wells can be optimized to make full use of the flow barriers for improving production.

Long horizontal wells can be drilled as close to the top of the oil zone as possible for developing thin bottom water reservoirs. The existence of low permeability flow barriers can improve the production performance of horizontal well in bottom water drive reservoir. The advantages of flow barriers include delaying water breakthrough, slowing water cut rising, and increasing swept area. Optimization of horizontal well placement with respect to the distribution of flow barriers could add value for reservoir systems with flow barriers. High resolution reservoir models can be used to simulate the impact of thin flow barriers in the system.

6.1 Apparatus and Computer-Program Implementations

One or more steps of the methods disclosed herein can be implemented using an apparatus, e.g., a computer system, such as the computer system described in this section, according to the following programs and methods. Such a computer system can also store and manipulate, e.g., data indicative of physical properties associated with materials in the subsurface formation, reservoir simulations for identifying "by-pass" oil areas, or measurements that can be used by a computer system implemented with steps of the methods described herein. The systems and methods may be implemented on various types of computer architectures, such as for example on a single general purpose computer, or a parallel processing computer system, or a workstation, or on a networked system (e.g., a client-server configuration such as shown in FIG. 26).

As shown in FIG. 26, the modeling computer system to implement one or more methods and systems disclosed herein can be linked to a network link which can be, e.g., part of a local area network ("LAN") to other, local computer systems and/or part of a wide area network ("WAN"), such as the Internet, that is connected to other, remote computer systems.

The system comprises any simulation or computer-implemented step of the methods described herein. For example, a software component can include programs that cause one or more processors to implement steps of accepting a plurality of parameters indicative of physical properties associated with materials in the subsurface formation, and/or parameters of reservoir simulations for identifying "by-pass" oil areas, and storing the parameters indicative of physical properties associated with materials in the subsurface formation, and/or parameters of reservoir simulations for identifying "by-pass" oil areas in the memory. For example, the system can accept commands for receiving parameters indicative of physical properties associated with materials in the subsurface formation, and/or parameters of reservoir simulations for identifying "by-pass" oil areas, that are manually entered by a user (e.g., by means of the user interface). The programs can cause the system to retrieve parameters indicative of physical properties associated with materials in the subsurface formation, and/or parameters of reservoir simulations for identifying "by-pass" oil areas, from a data store (e.g., a database). Such a data store can be stored on a mass storage (e.g., a hard drive) or other computer readable medium and loaded into the memory of the computer, or the data store can be accessed by the computer system by means of the network.

7. REFERENCES CITED

All references cited herein are incorporated herein by reference in their entirety and for all purposes to the same extent as if each individual publication or patent or patent application was specifically and individually indicated to be incorporated by reference in its entirety herein for all purposes. Discussion or citation of a reference herein will not be construed as an admission that such reference is prior art to the present invention.

8. MODIFICATIONS

Many modifications and variations of this invention can be made without departing from its spirit and scope, as will be apparent to those skilled in the art. The specific embodiments described herein are offered by way of example only, and the invention is to be limited only by the terms of the claims, along with the full scope of equivalents to which such claims are entitled.

As an illustration of the wide scope of the systems and methods described herein, the systems and methods described herein may be implemented on many different types of processing devices by program code comprising program instructions that are executable by the device processing subsystem. The software program instructions may include source code, object code, machine code, or any other stored data that is operable to cause a processing system to perform the methods and operations described herein. Other implementations may also be used, however, such as firmware or even appropriately designed hardware configured to carry out the methods and systems described herein.

The systems' and methods' data (e.g., associations, mappings, data input, data output, intermediate data results, final data results, etc.) may be stored and implemented in one or more different types of computer-implemented data stores, such as different types of storage devices and programming constructs (e.g., RAM, ROM, Flash memory, flat files, databases, programming data structures, programming variables, IF-THEN (or similar type) statement constructs, etc.). It is noted that data structures describe formats for use in organizing and storing data in databases, programs, memory, or other computer-readable media for use by a computer program.

The systems and methods may be provided on many different types of computer-readable media including computer storage mechanisms (e.g., CD-ROM, diskette, RAM, flash memory, computer's hard drive, etc.) that contain instructions (e.g., software) for use in execution by a processor to perform the methods' operations and implement the systems described herein.

The computer components, software modules, functions, data stores and data structures described herein may be connected directly or indirectly to each other in order to allow the flow of data needed for their operations. It is also noted that a module or processor includes but is not limited to a unit of code that performs a software operation, and can be implemented for example as a subroutine unit of code, or as a software function unit of code, or as an object (as in an object-oriented paradigm), or as an applet, or in a computer script language, or as another type of computer code. The software components and/or functionality may be located on a single computer or distributed across multiple computers depending upon the situation at hand.

What is claimed is:

1. A method for optimizing the location of wells in a subsurface formation having flow barriers for use in hydrocarbon recovery from the subsurface formation, comprising:

receiving, through a computer system, data indicative of by-pass oil areas in the subsurface formation from one or more reservoir simulations;

identifying, through a computer system, one or more flow barriers in the subsurface formation based on the by-pass oil areas identified by the one or more reservoir simulations; and predicting a lateral extension of the identified one or more flow barriers in the subsurface formation;

wherein, based upon the predicted lateral extension, one or more horizontal infill wells are placed at areas of the subsurface formation that have a predefined level of remaining oil saturation and such that the identified one or more flow barriers are positioned between the paths of the one or more horizontal infill wells and an area of contact between water and oil in the subsurface formation; and wherein production of fluids, comprising hydrocarbons, from the one or more horizontal infill wells optimizes hydrocarbon recovery from the subsurface formation.

2. The method of claim 1, further comprising outputting or displaying one or more parameters indicative of a location of placement of one or more of the horizontal infill wells.

3. The method of claim 1, further comprising identifying the one or more flow barriers in the subsurface formation from well logs.

4. The method of claim 1, wherein a horizontal section of the at least one horizontal infill well is drilled to the extent permitted by a spacing of the one or more horizontal infill wells.

5. The method of claim 1, wherein at least one horizontal infill well is placed relative to a top of the oil column of the subsurface formation at a stand-off (z/h) in a range of from z/h=0.7 to z/h=0.9, where z is a stand-off distance of the at least one horizontal infill well from the top of the oil column and h is a total height of the oil column from the top to the contact between water and oil.

6. The method of claim 1, wherein the step of predicting a lateral extension of the identified one or more flow barriers further comprises predicting a vertical proportion of the identified one or more flow barriers.

7. The method of claim 1, wherein the subsurface formation comprises bottom water or edgewater.

8. The method of claim 1, further comprising producing fluids from the one or more horizontal infill wells with small pressure drawdown and then increasing the production rate when a water cut is high.

9. A method for optimizing the location of wells in a subsurface formation having flow barriers for use in hydrocarbon recovery from the subsurface formation, comprising:

identifying, through a computer system, by-pass oil areas of the subsurface formation using one or more reservoir simulations:

identifying, through a computer system, one or more flow barriers in the subsurface formation from well logs based on the by-pass oil areas identified by the one or more reservoir simulations;

predicting a lateral extension of the identified one or more flow barriers in the subsurface formation;

determining a placement of one or more horizontal infill wells, based upon the predicted lateral extension, at areas of the subsurface formation that have a predefined level of remaining oil saturation and such that the identified one or more flow barriers are positioned between the paths of the one or more horizontal infill wells and an area of contact between water and oil in the subsurface formation;

wherein production of fluids, comprising hydrocarbons, from the one or more horizontal infill wells optimizes hydrocarbon recovery from the subsurface formation.

10. The method of claim 9, further comprising outputting or displaying one or more parameters indicative of a location of placement of one or more of the horizontal infill wells.

11. The method of claim 9, wherein identifying, through a computer system, by-pass oil areas of the subsurface formation using a reservoir simulation further comprises: receiving data indicative of physical properties associated with materials in the subsurface formation, and performing one or more reservoir simulations for identifying by-pass oil areas.

12. The method of claim 9, wherein a horizontal section of the at least one horizontal infill well is determined to have an extent permitted by a spacing of the one or more horizontal infill wells.

13. The method of claim 9, wherein identifying, through a computer system, the by-pass oil areas using one or more reservoir simulations further comprises computing a reservoir model of the subsurface formation having one or more parameters representative of a proportion of flow barriers in the subsurface formation, wherein the computing comprises varying the proportion of flow barriers in the subsurface formation.

14. The method of claim 9, wherein identifying, through a computer system, the by-pass oil areas using one or more reservoir simulations further comprises computing a reservoir model of the subsurface formation having one or more parameters representative of a correlation length of flow barriers in the subsurface formation, wherein the computing comprises varying the correlation length of the flow barriers.

15. The method of claim 9, wherein the step of predicting a lateral extension of the identified one or more flow barriers further comprises predicting a vertical proportion of the identified one or more flow barriers.

16. The method of claim 9, wherein the subsurface formation comprises bottom water or edgewater.

17. A method for improving production of hydrocarbons from a subsurface formation having flow barriers, comprising:

identifying by-pass oil areas of the subsurface formation using one or more reservoir simulations;

identifying one or more flow barriers in the subsurface formation based on the by-pass oil areas identified by the one or more reservoir simulations;

predicting a lateral extension of the identified one or more flow barriers in the subsurface formation;

placing one or more horizontal infill wells, based upon the predicted lateral extension, at areas of the subsurface formation that have a predefined level of remaining oil saturation and such that the identified one or more flow barriers are positioned between the paths of the one or more horizontal infill wells and an area of contact between water and oil in the subsurface formation; and producing fluids comprising hydrocarbons from the one or more horizontal infill wells with small drawdown, thereby improving production of hydrocarbons from the subsurface formation.

18. The method of claim 17, further comprising, prior to placing at least one horizontal infill well, drilling one or more pilot holes to verify the existence of flow barriers.

19. The method of claim 17, further comprising increasing the production rate of fluids from the subsurface formation from the one or more horizontal infill wells when the water cut is high.

20. The method of claim 19, wherein the water cut is high when the water is 80% to 90% of the fluid produced.

21. The method of claim 17, wherein identifying by-pass oil areas of subsurface formation using a reservoir simulation further comprises: receiving data indicative of physical properties associated with materials in the subsurface formation, and performing one or more reservoir simulations for identifying by-pass oil areas.

22. The method of claim 17, wherein a horizontal section of at least one horizontal infill well is drilled to the extent permitted by the spacing of the one or more horizontal infill wells.

23. The method of claim 17, wherein identifying the by-pass oil areas using one or more reservoir simulations further comprises computing a reservoir model of the subsurface formation having one or more parameters representative of a proportion of flow barriers in the subsurface formation, wherein the computing comprises varying the proportion of flow barriers in the subsurface formation.

24. The method of claim 17, wherein identifying the by-pass oil areas using one or more reservoir simulations further comprises computing a reservoir model of the subsurface formation having one or more parameters representative of a correlation length of flow barriers in the subsurface formation, wherein the computing comprises varying the correlation length of the flow barriers.

25. The method of claim 17, wherein the step of predicting a lateral extension of the identified one or more flow barriers further comprises predicting a vertical proportion of the identified one or more flow barriers.

26. The method of claim 17, wherein the subsurface formation comprises bottom water or edgewater.

27. A system for use in optimizing the location of wells in a subsurface formation having flow barriers for use in hydrocarbon recovery from the subsurface formation, the system comprising:

one or more data structures resident in a memory for storing data representative of by-pass oil areas in the subsurface formation from one or more reservoir simulations; and software instructions, for executing on one or more data processors, to identify one or more flow barriers in the subsurface formation based on the by-pass oil areas identified by the one or more reservoir simulations and to predict a lateral extension of the identified flow barriers in the subsurface formation; wherein:

based upon the predicted lateral extension, one or more horizontal infill wells are placed at areas of the subsurface formation that have a predefined level of remaining oil saturation and such that the one or more flow barriers are positioned between the paths of the one or more horizontal infill wells and an area of contact between water and oil in the subsurface formation; and production of fluids, comprising hydrocarbons, from the one or more horizontal infill wells optimizes hydrocarbon recovery from the subsurface formation.

* * * * *